US009498963B2

(12) United States Patent
Yamasaki et al.

(10) Patent No.: US 9,498,963 B2
(45) Date of Patent: Nov. 22, 2016

(54) FLOW PATH MEMBER, LIQUID EJECTING HEAD, LIQUID EJECTING APPARATUS AND LIQUID STIRRING METHOD

(71) Applicant: SEIKO EPSON CORPORATION, Tokyo (JP)

(72) Inventors: Keigo Yamasaki, Matsumoto (JP); Yutaka Kobayashi, Ikeda-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/849,843

(22) Filed: Sep. 10, 2015

(65) Prior Publication Data

US 2016/0075141 A1 Mar. 17, 2016

(30) Foreign Application Priority Data

Sep. 11, 2014 (JP) ..... 2014-185690

(51) Int. Cl.
*B41J 2/175* (2006.01)
*B41J 2/14* (2006.01)

(52) U.S. Cl.
CPC ..... *B41J 2/175* (2013.01); *B41J 2/14233* (2013.01); *B41J 2002/14241* (2013.01); *B41J 2002/14362* (2013.01); *B41J 2002/14419* (2013.01); *B41J 2002/14467* (2013.01)

(58) Field of Classification Search
CPC ..... B41J 2/175; B41J 2/17513
See application file for complete search history.

(56) References Cited

U.S. PATENT DOCUMENTS 8,740,364 B2 * 6/2014 Xie ..... B41J 2/1404 347/89
2010/0073433 A1 3/2010 Shimizu et al.

FOREIGN PATENT DOCUMENTS

JP 2010-076176 A 4/2010
JP 2010-184424 A 8/2010

* cited by examiner

*Primary Examiner* — Henok Legesse
(74) *Attorney, Agent, or Firm* — Workman Nydegger

(57) ABSTRACT

A flow path member includes a liquid flow path which includes a flow path inlet portion which has a first inlet port and a second inlet port, and a flow path outlet portion which has a first outlet port communicating with the first inlet port and a second outlet port communicating with the second inlet port, in which, in the flow path inlet portion, the first inlet port and the second inlet port are aligned in a reference direction, and in which, in a flow path extending from the first inlet port to the first outlet port and a flow path extending from the second inlet port to the second outlet port, at least parts of the flow paths, in terms of the lengths of the respective flow paths, are disposed in a direction different from the reference direction.

19 Claims, 16 Drawing Sheets

FLOW PATH MEMBER, LIQUID EJECTING HEAD, LIQUID EJECTING APPARATUS AND LIQUID STIRRING METHOD

CROSS-REFERENCE TO RELATED APPLICATIONS

The present application claims priority to Japanese Patent Application No. 2014-185690 filed on Sep. 11, 2014, which is hereby incorporated by reference in its entirety.

BACKGROUND

1. Technical Field

The present invention relates to a flow path member having a liquid flow path provided therein, a liquid ejecting head, a liquid ejecting apparatus, and a liquid stirring method of stirring liquid and, particularly, relates to a flow path member using ink as the liquid, an ink jet type recording head, an ink jet type recording apparatus, and an ink stirring method.

2. Related Art

A liquid ejecting apparatus represented by an ink jet type recording apparatus, such as an ink jet type printer and a plotter, includes a liquid ejecting head which can eject droplets of liquid, such as ink stored in a cartridge and a tank.

In an ink jet type recording head as a representative example of a liquid ejecting head ejecting liquid droplets, For example, a pressure generation chamber which communicates with nozzle openings through which ink is ejected and a pressure generation unit which causes a pressure change of the ink in the pressure generation chamber are provided and ink droplets are ejected from the nozzle openings by causing the pressure generation unit to cause a pressure change of the ink in the pressure generation chamber.

In a case of such an ink jet type recording head, in ink not subjected to distribution over the respective pressure generation chambers, a laminar flow having a high concentration and a laminar flow having a low concentration are formed in liquid due to sedimentation of components contained in the ink. When the ink having the laminar flow described above is supplied, without change, to the respective pressure generation chamber, the nozzle openings are divided into a group of nozzle openings through which the ink having a high concentration is ejected and a group of nozzle openings through which the ink having a low concentration is ejected. As a result, there is a problem in that unevenness of concentration occurs in a printing result.

Accordingly, an ink jet printer in which a sub-tank is provided in a flow path not subjected to distribution over respective pressure generation chambers and ink is stirred by a stirring sphere provided in the sub-tank is proposed (see JP-A-2010-184424, for example).

In addition, a liquid discharging head in which a flow path branches in the middle of a flow path and ink in each branched flow path is heated by a heater, in such a manner that the ink is effectively heated is proposed (see JP-A-2010-76176, for example).

However, in a configuration in which the ink is stirred by the stirring sphere, as in the case of JP-A-2010-184424, when the sub-tank is stopped, the stirring sphere does not move. As a result, there is a problem in that an ink stirring effect cannot be obtained. Furthermore, when a stirring unit, such as a stirring sphere, is provided, there is a problem in that the size of the ink jet type recording head is increased.

An ink jet type recording apparatus in which ink is stirred by causing the ink to be circulated in a portion between a storage unit storing the ink and an ink jet type recording head is proposed. However, there is a problem in that the size of the ink jet type recording apparatus is increased because it is necessary to provide a circulation unit.

Even when the flow path branches, as in the case of JP-A-2010-76176, there is a problem in that the ink cannot be effectively stirred.

The problems described above are not limited to a liquid ejecting head represented by an ink jet type recording head and a liquid ejecting apparatus but is shared by a flow path member used in other devices.

SUMMARY

An advantage of some aspects of the invention is to provide a flow path member which can easily prevent sedimentation of components of liquid and can achieve a reduction in size, a liquid ejecting head, a liquid ejecting apparatus, and a liquid stirring method.

According to an aspect of the invention, there is provided a liquid flow path including a liquid flow path which includes a flow path inlet portion which has a first inlet port and a second inlet port, and a flow path outlet portion which has a first outlet port communicating with the first inlet port and a second outlet port communicating with the second inlet port, in which, in the flow path inlet portion, the first inlet port and the second inlet port may be aligned in a reference direction, and in which, in a flow path extending from the first inlet port to the first outlet port and a flow path extending from the second inlet port to the second outlet port, at least parts of the flow paths, in terms of the lengths of the respective flow paths, may be disposed in a direction different from the reference direction.

In this case, in the middle of the flow path, the arrangement of the flow path extending from the first inlet port to the first outlet port and the flow path extending from the second inlet port to the second outlet port is changed to an arrangement in which an arrangement direction of flow paths is changed to a different direction. As a result, a deviation in the concentration distribution due to sedimentation of components of the liquid can ease off in the flow path outlet portion.

It is preferable that each of the first outlet port and the second outlet port has at least two or more flow path outlet ports, respective outlet ports of the first outlet port and respective outlet ports of the second outlet port are alternately disposed.

In this case, the flow path branches in the middle thereof, and thus the number of boundaries of liquids passing through the first outlet port and the second outlet port is increased. As a result, a deviation in the concentration distribution of the liquid can further ease off in a flow path outlet portion.

It is preferable that when seeing a branch point in which the flow path branches in a portion between the first inlet port and the first outlet port from an upstream side to a downstream side in the liquid flow path, the branch point has, at least, a shape selected from a group of square shapes and curve shapes.

In this case, compared to in a case where a branch point has a flat shape opposite to a flowing direction, flow path resistance in the branch point can be reduced and, further, staying of the liquid can be prevented. As a result, initial filling properties of the liquid and air-bubble discharge properties can be improved.

It is preferable that at least either a group of a flow path of the first inlet port and a flow path of the first outlet port or a group of a flow path of the second inlet port and a flow path of the second outlet port has the same flow-path sectional area.

In this case, a difference between the flow path resistance of the flow path inlet portion and the flow path resistance of the flow path outlet portion can be prevented.

It is preferable that in a portion between the first inlet port and the first outlet port, a flow-path inner wall surface having an inclined shape is provided so that a width of the liquid flow path in the reference direction is gradually increased, as the liquid flow path extends to the first outlet port, and in a portion between the second inlet port and the second outlet port, a flow-path inner wall surface having an inclined shape is provided so that a width of the liquid flow path in the reference direction is gradually increased, as the liquid flow path extends to the second outlet port.

In this case, staying of the liquid is prevented by the flow-path inner wall surface having an inclined shape. As a result, initial filling properties of the liquid and air-bubble discharge properties can be improved.

It is preferable that the reference direction which is an alignment direction of the first inlet port and the second inlet port is a vertical direction and the second inlet port is disposed on a lower side in the vertical direction, and a height of the second inlet port in the vertical direction is set to a value equal to or greater than a maximum sedimentation height of sedimentation components contained in the liquid.

In this case, sedimentation of components of the liquid can effectively ease off.

According to another aspect of the invention, there is provided a liquid ejecting head including the flow path member of the aspect.

In this case, sedimentation of components of the liquid can easily ease off without a stirring unit, such as a stirring sphere, and a circulation unit. As a result, the size of the liquid ejecting head can be reduced.

According to still another aspect of the invention, there is provided a liquid ejecting apparatus including the flow path member of the aspect.

In this case, sedimentation of components of the liquid can easily ease off without a stirring unit, such as a stirring sphere, and a circulation unit. As a result, the size of the liquid ejecting apparatus can be reduced.

According to still another aspect of the invention, there is provided a liquid stirring method in which a liquid flow path includes a flow path inlet portion which has a first inlet port and a second inlet port, and a flow path outlet portion which has a first outlet port communicating with the first inlet port and a second outlet port communicating with the second inlet port, the method including: aligning the first inlet port and the second inlet port in the flow path inlet portion in a reference direction; and disposing at least parts of a flow path extending from the first inlet port to the first outlet port and a flow path extending from the second inlet port to the second outlet port in terms of the lengths of the respective flow paths, in a direction intersecting the reference direction.

In this case, in the middle of the flow path, the arrangement of the flow path extending from the first inlet port to the first outlet port and the flow path extending from the second inlet port to the second outlet port is changed to an arrangement in which an arrangement direction of the flow paths is changed to a different direction. As a result, a deviation in the concentration distribution due to sedimentation of components of the liquid can ease off in the flow path outlet portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, details of embodiments of the invention will be described.

Embodiment 1

Figure 1:
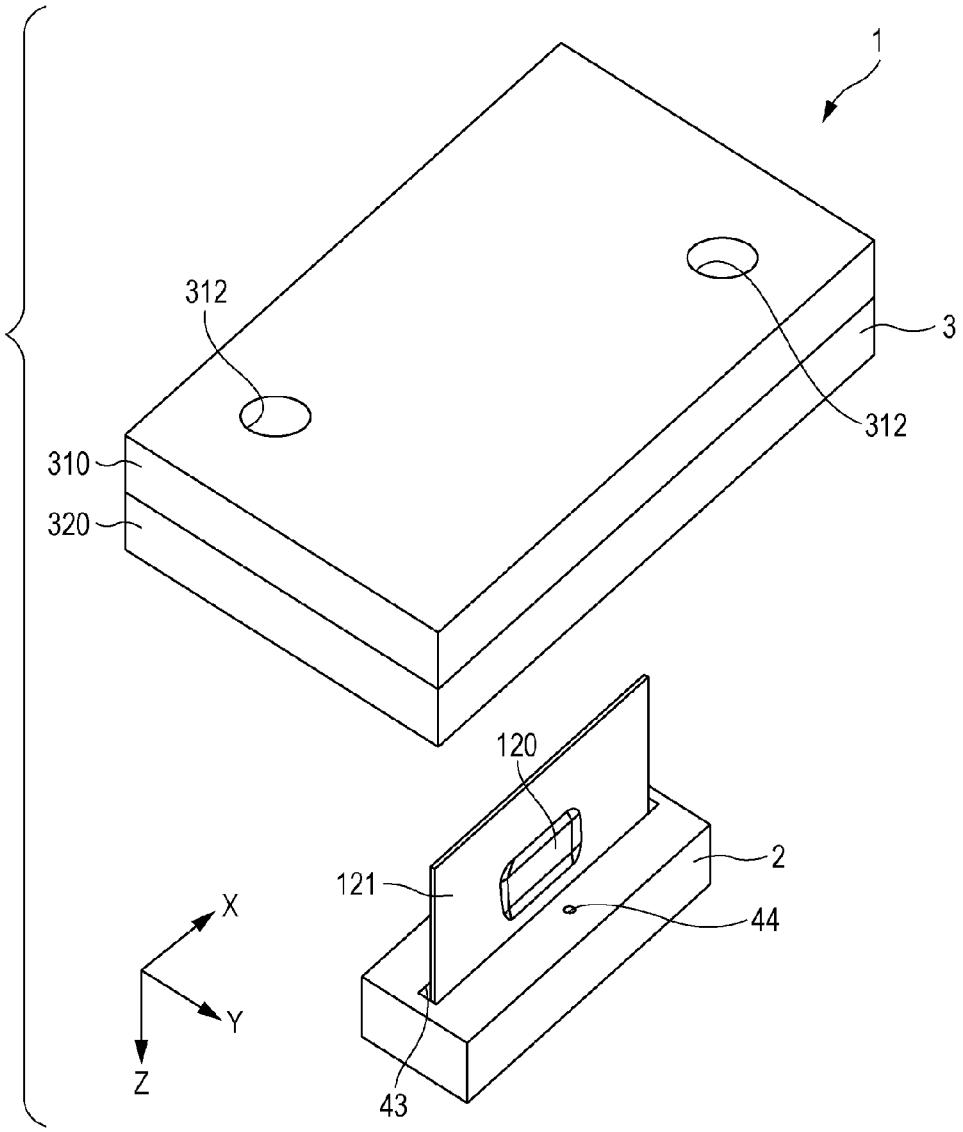
FIG. 1 is an exploded perspective view of a recording head according to Embodiment 1.

FIG. 1 is an exploded perspective view of an ink jet type recording head as an example of a liquid ejecting head according to Embodiment 1 of the invention.

An ink jet type recording head 1 of the embodiment includes a head main body 2 and a flow path member 3, as illustrated in FIG. 1. The head main body 2 ejects ink. The flow path member 3 is fixed to the head main body 2 and supplies ink to the head main body 2.

Figure 2:
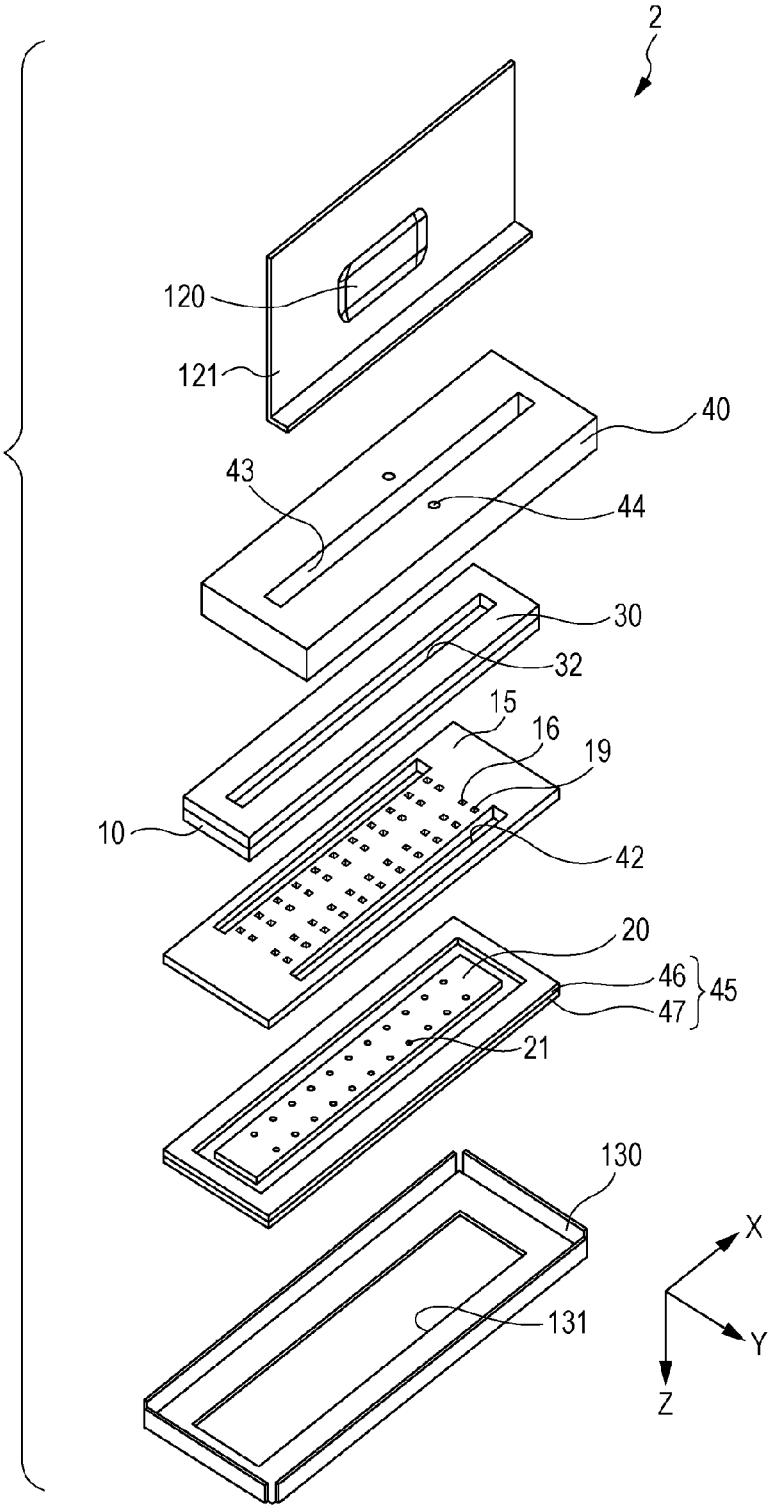
FIG. 2 is an exploded perspective view of a head main body according to Embodiment 1.
Figure 3:
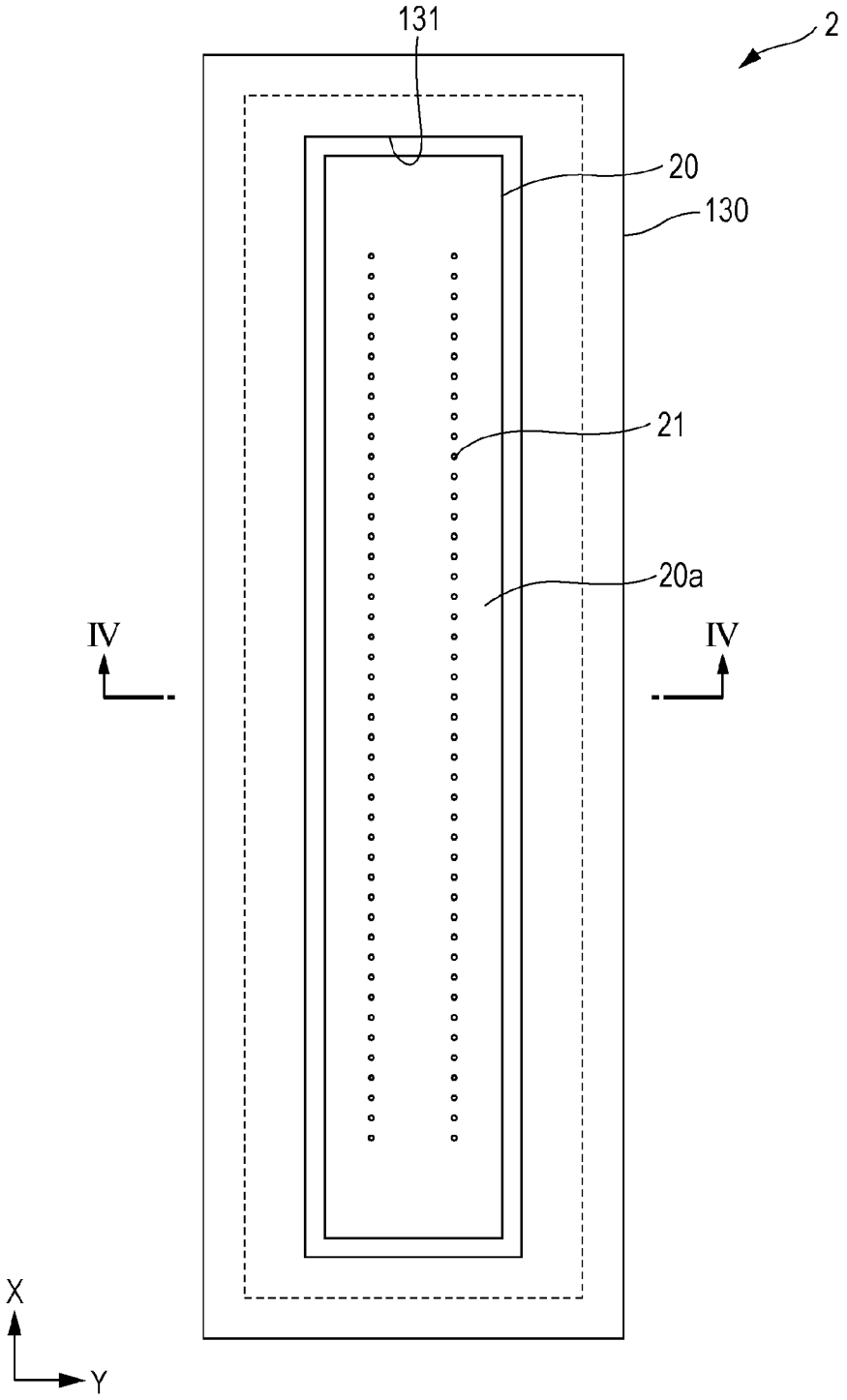
FIG. 3 is a plan view of the head main body according to Embodiment 1.
Figure 4:
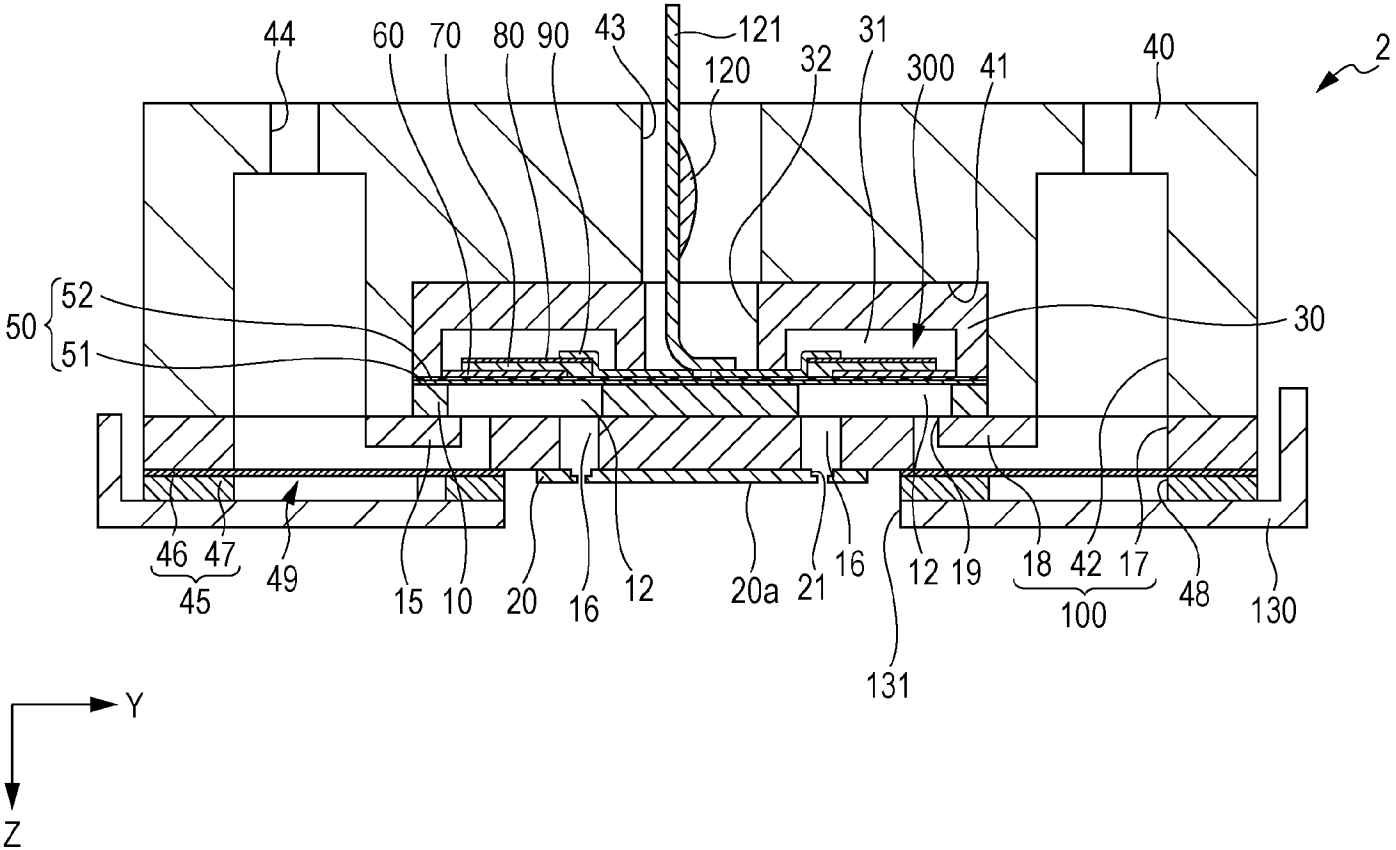
FIG. 4 is a sectional view of the head main body according to Embodiment 1.

First, an example of the head main body 2 of the embodiment will be described with reference to FIGS. 2 to 4. Furthermore, FIG. 2 is an exploded perspective view of a head main body according to Embodiment 1 of the invention. FIG. 3 is a plan view of the head main body. FIG. 4 is a sectional view taken along line IV-IV of FIG. 3.

Pressure generation chambers 12 which are formed by anisotropic etching from one surface side and are partitioned by a plurality of partition walls are aligned in an alignment direction of a plurality of nozzle openings 21 through which ink is discharged, in a flow path forming substrate 10 constituting the head main body 2 of the embodiment, as illustrated in the accompanying drawings. Hereinafter, the direction described above will be referred to as an alignment direction of the pressure generation chambers 12 or a first direction X. Furthermore, a plurality of rows in each of which the pressure generation chambers 12 are aligned in the first direction X are provided in the flow path forming substrate 10. In the embodiment, the number of rows is two. Hereinafter, a row alignment direction in which a plurality of rows of the pressure generation chambers 12 are aligned will be referred to as a second direction Y. Furthermore, a direction perpendicular to both the first direction X and the second direction Y will be referred to as a third direction Z. The first direction X, the second direction Y, and the third direction Z are perpendicular to one another. However, the configuration is not particularly limited thereto. The directions cross one another at angles other than a right angle.

Furthermore, a communication plate 15 and a nozzle plate 20 are laminated in order, on one surface side of the flow path forming substrate 10 in the third direction Z.

A nozzle communication path 16 is provided in the communication plate 15 to allow the pressure generation chambers 12 to communicate with the nozzle opening 21. The size of the communication plate 15 is larger than that of the flow path forming substrate 10 and the size of the nozzle plate 20 is smaller than that of the flow path forming substrate 10. The communication plate 15 is provided as described above, and thus the nozzle opening 21 of the nozzle plate 20 is separated from the pressure generation chambers 12. Accordingly, it is difficult for the ink in the pressure generation chambers 12 to be influenced by thickening due to evaporation of the moisture in the ink, which occurs in the ink in the vicinity of the nozzle opening 21. Furthermore, the nozzle plate 20 can be any size as long as it can cover the opening of the nozzle communication path 16 which allows the pressure generation chambers 12 to communicate with the nozzle opening 21. Accordingly, the nozzle plate 20 can have a relatively small area, and thus a reduction in the cost can be obtained. Furthermore, in the embodiment, a surface to which the nozzle opening 21 of the nozzle plate 20 is open and from which ink droplets are discharged will be referred to as a liquid ejection surface 20*a*.

A first manifold portion 17 and a second manifold portion 18 which constitute a part of a manifold 100 are provided in the communication plate 15.

The first manifold portion 17 is formed in a state where the first manifold portion 17 passes through the communication plate 15 in the third direction Z.

Furthermore, the second manifold portion 18 is provided to open to the nozzle plate 20 side of the communication plate 15, in a state where the second manifold portion 18 does not pass through the communication plate 15 in the third direction Z.

Furthermore, in the communication plate 15, supply communication paths 19 which communicate with one end portion of the pressure generation chambers 12 in the second direction Y are separately provided in relation to the respective pressure generation chambers 12. The supply communication path 19 allows the second manifold portion 18 to communicate with the pressure generation chambers 12. In other words, the supply communication paths 19 are aligned in the first direction X, in relation to the manifold 100.

The nozzle openings 21 which communicate with each pressure generation chamber 12 through the nozzle communication paths 16 are formed in the nozzle plate 20. In other words, the nozzle openings 21, which eject liquid (in other words, ink) of the same kind are aligned in the first direction X. Two rows, each of which is constituted of the nozzle openings 21 aligned in the first direction X, are formed in the second direction Y.

Meanwhile, in the flow path forming substrate 10, a diaphragm 50 is formed on the side opposite to the communication plate 15. In the embodiment, an elastic film 51 and an insulator film 52 are provided as the diaphragm 50. The elastic film 51 is provided on the flow path forming substrate 10 side and is formed of oxide silicon. The insulator film 52 is provided on the elastic film 51 and is formed of zirconium oxide. The flow path forming substrate 10 is subjected to anisotropic etching from one surface side (which is the surface side to which the nozzle plate 20 adheres), in such a manner that the liquid flow paths, such as the pressure generation chambers 12, are formed. The other surface of the pressure generation chambers 12 is formed by the elastic film 51.

Furthermore, a piezoelectric actuator 300 is provided above the diaphragm 50 of the flow path forming substrate 10. The piezoelectric actuator 300 has a first electrode 60, a piezoelectric layer 70, and a second electrode 80. In the embodiment, the piezoelectric actuator 300 is a pressure generation unit which causes a pressure change in the flow path. More particularly, the piezoelectric actuator 300 is a drive element which is driven by a driving circuit 120 which is a semiconductor device and will be described below. In this case, the piezoelectric actuator 300 is a portion including the first electrode 60, the piezoelectric layer 70, and the second electrode 80. Generally, an electrode of the piezoelectric actuator 300 is set to a common electrode and the other electrode is subjected to patterning for each pressure generation chamber 12. In the embodiment, the first electrode 60 continuously extends over a plurality of piezoelectric actuators 300 and is set to a common electrode. The second electrode 80 is separately provided for each piezoelectric actuator 300 and is set to an individual electrode. Needless to say, there is no problem even when the configuration of the common electrode and the individual electrode is reversed for the convenience of a driving circuit or wiring. In other words, the first electrode 60 may continuously extend over the plurality of piezoelectric actuators 300 and is set to the common electrode and the second electrode may be separately provided for each piezoelectric actuator 300 and is set to the individual electrode. Furthermore, in the example described above, the configuration in which the diaphragm 50 is constituted of the elastic film 51 and the insulator film 52 is exemplified. However, needless to say, the configuration is not limited thereto. It may be configured so that, for example, either the elastic film 51 or the insulator film 52 is provided as the diaphragm 50. Furthermore, only the first electrode 60 may be operated as a diaphragm, in a state where the elastic film 51 and the insulator film 52 are not provided as the diaphragm 50. In addition, the piezoelectric actuator 300 itself may also practically function as the diaphragm.

The piezoelectric layer 70 is formed of an oxide piezoelectric material which is formed on the first electrode 60 and has a polarization structure. The piezoelectric layer 70 can be formed of a perovskite type oxide represented by a general formula $ABO_3$. A lead-based piezoelectric material containing a lead or a non-lead-based piezoelectric material containing no lead and the like can be used as the material of the piezoelectric layer 70.

Furthermore, one end of the lead electrode 90 which is lead-out wiring is connected to the second electrode 80 of the piezoelectric actuator 300. The other end portion of the lead electrode 90 is led out to a portion which is the portion on the diaphragm 50 and is located in a portion between the adjacent rows of the piezoelectric actuators 300 in the second direction Y.

Furthermore, a protection substrate 30 of which the size is approximately the same as that of the flow path forming substrate 10 adheres to a surface of the flow path forming substrate 10, which is the surface on the piezoelectric actuator 300 side. The protection substrate 30 has a holding portion 31 which is a space for protecting the piezoelectric actuator 300. Two holding portions 31 are aligned in the second direction Y, in a portion between the rows of the piezoelectric actuators 300, which are aligned in the first direction X. Furthermore, in the protection substrate 30, a through-hole 32 which passes through the protection substrate 30 in the third direction Z is provided in a portion between the two holding portions 31 aligned in the second direction Y. An end portion of the lead electrode 90 led out from an electrode of the piezoelectric actuator 300 extends so that the end portion of the lead electrode 90 is exposed to the inside of the through-hole 32. The lead electrode 90 and a wiring substrate 121 having the driving circuit 120, such as a driving IC, mounted thereon are electrically connected in the through-hole 32.

A case member 40 which forms, along with the flow path forming substrate 10, the manifold 100 communicating with a plurality of pressure generation chambers 12 is fixed to the upper side of the protection substrate 30. In a plan view, the case member 40 and the communication plate 15 described above have substantially the same shape. The case member 40 adheres to the protection substrate 30 and, further, adheres to the communication plate 15 described above. Specifically, on the protection substrate 30 side of the case member 40, a concave portion 41 having a depth deep enough to allow both the flow path forming substrate 10 and the protection substrate 30 to be accommodated therein is provided. The opening area of the concave portion 41 is larger than that of a surface of the protection substrate 30, which is the surface adhering to the flow path forming substrate 10. The opening surface of the concave portion 41, which is located on the nozzle plate 20 side, is sealed by the communication plate 15, in a state where the flow path forming substrate 10 and the like are accommodated in the concave portion 41. Accordingly, in an outer circumferential portion of the flow path forming substrate 10, a third manifold portion 42 is formed by both the case member 40 and the flow path forming substrate 10. The manifold 100 of the embodiment is constituted by the first manifold portion 17, the second manifold portion 18, and the third manifold portion 42. The first manifold portion 17 and the second manifold portion 18 are provided in the communication plate 15. The third manifold portion 42 is formed by the case member 40 and the flow path forming substrate 10. The manifold 100 continuously extends in the first direction X which is the alignment direction of the pressure generation chambers 12. The supply communication paths 19 which allow the respective pressure generation chambers 12 to communicate with the manifold 100 are aligned in the first direction X.

In the communication plate 15, a compliance substrate 45 is provided on the surface to which the first manifold portion 17 and the second manifold portion 18 are open. The compliance substrate 45 seals openings of both the first manifold portion 17 and the second manifold portion 18, which are openings located on the liquid ejection surface 20*a* side. In the embodiment, the compliance substrate 45 having such a configuration includes a sealing film 46 and a fixing substrate 47. The sealing film 46 is formed of a thin film having flexibility. The fixing substrate 47 is formed of a hard material, such as a metal. A part of the fixing substrate 47, which is an area facing the manifold 100, is an opening portion 48 which is formed by completely removing a part of the fixing substrate 47 in a thickness direction. Accordingly, one surface of the manifold 100 forms a compliance portion 49 which is a flexible portion sealed by only the sealing film 46 having flexibility.

Furthermore, in the case member 40, an introduction path 44 communicating with the manifold 100 is provided to supply ink to each manifold 100. In addition, in the case member 40, a connection port 43 which communicate with the through-hole 32 of the protection substrate 30 and in which the wiring substrate 121 is inserted.

A cover head 130 is provided on the liquid ejection surface 20*a* side of the nozzle plate 20. The cover head 130 adheres to a surface of the compliance substrate 45, which is the surface on the side opposite to the communication plate 15. The cover head 130 seals a space of the compliance portion 49, which is a space on the side opposite to the flow path (in other words, the manifold 100). Furthermore, an exposure opening portion 131 which allows the nozzle openings 21 to be exposed is provided in the cover head 130. In the embodiment, the exposure opening portion 131 is a large enough size to allow the nozzle plate 20 to be exposed.

In the embodiment, the end portion of the cover head 130 is bent from the liquid ejection surface 20*a* side so that the cover head 130 covers the side surface (which is the surface crossing the liquid ejection surface 20*a*) of the head main body 2.

When the head main body 2 having the configuration described above ejects the ink, the ink sent from the flow path member 3 is fed from the introduction path 44, and then the inner portion of a flow path extending from the manifold 100 to the nozzle opening 21 is filled with the ink. Next, voltage is applied to each piezoelectric actuator 300 corresponding to the pressure generation chamber 12, in accordance with signals from the driving circuit 120, in such a manner that the diaphragm 50 and the piezoelectric actuator 300 are flexibly deformed. As a result, the pressure in the pressure generation chambers 12 is increased, and thus ink droplets are ejected from a predetermined nozzle opening 21.

Furthermore, the surface of the head main body 2 having the configuration described above, which is the surface on the side opposite to the liquid ejection surface 20*a*, is directly fixed to the flow path member 3 or is fixed to the flow path member 3 through another flow path member, a sealing member, or the like.

Figure 5:
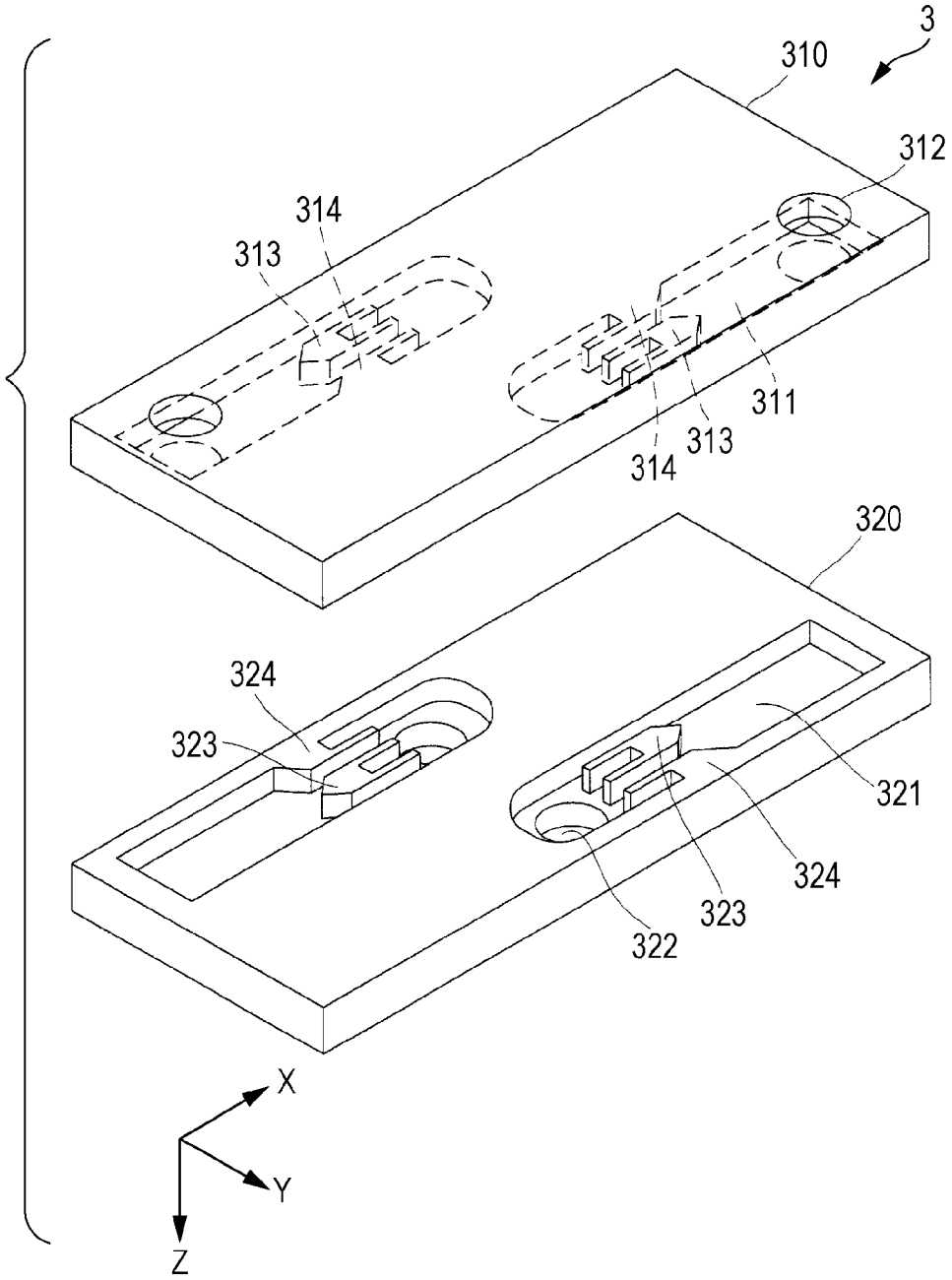
FIG. 5 is an exploded perspective view of a flow path member according to Embodiment 1.
Figure 6A:
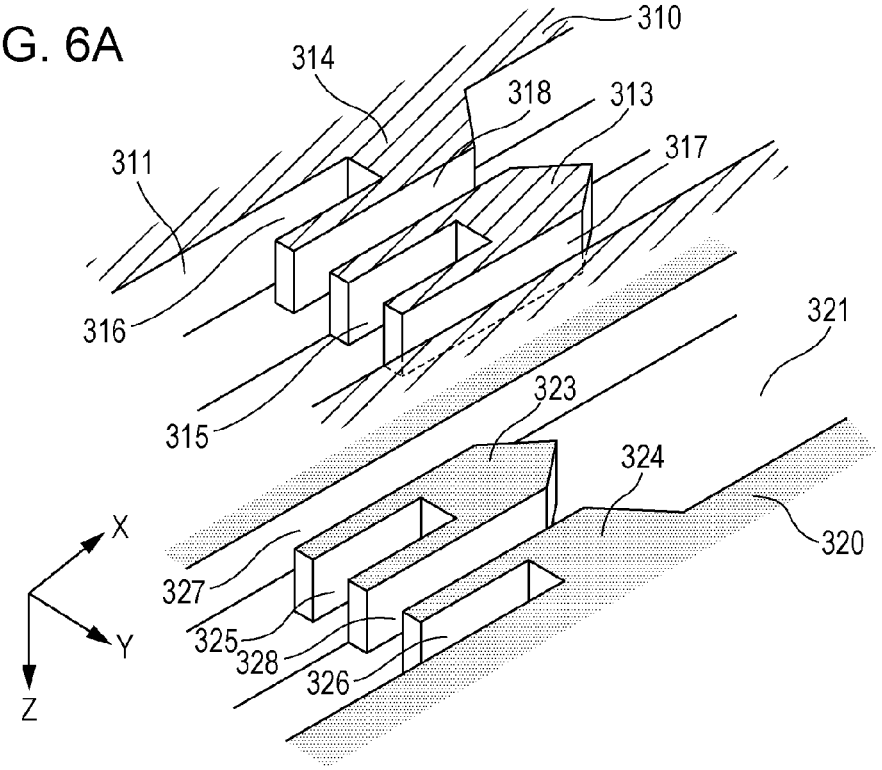
FIGS. 6A and 6B are perspective views of principal portions of the flow path member according to Embodiment 1, in which a part of the flow path member is cut off.
Figure 6B:
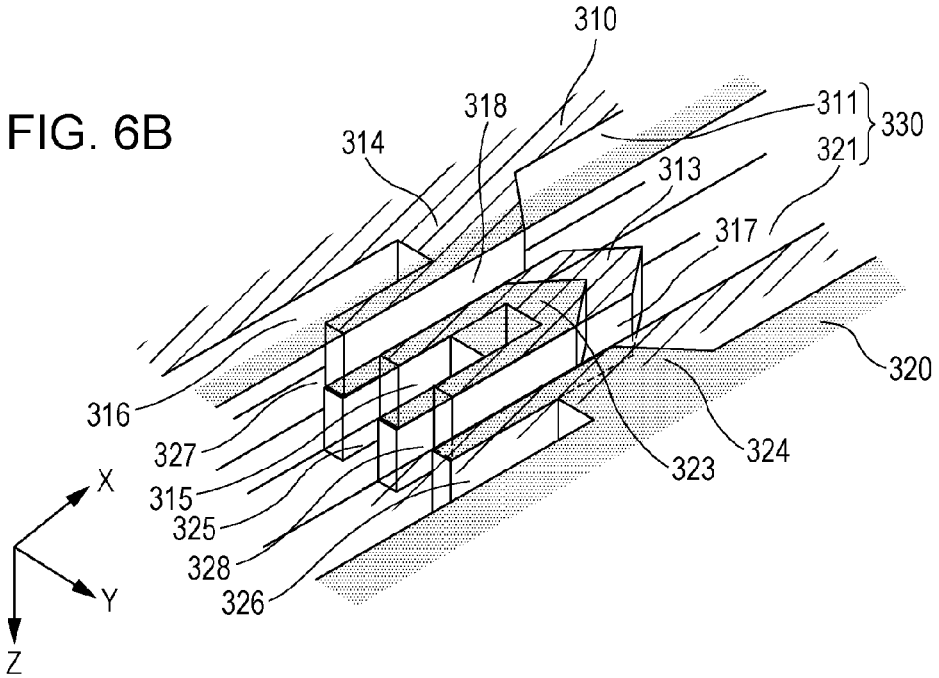
Figure 7:
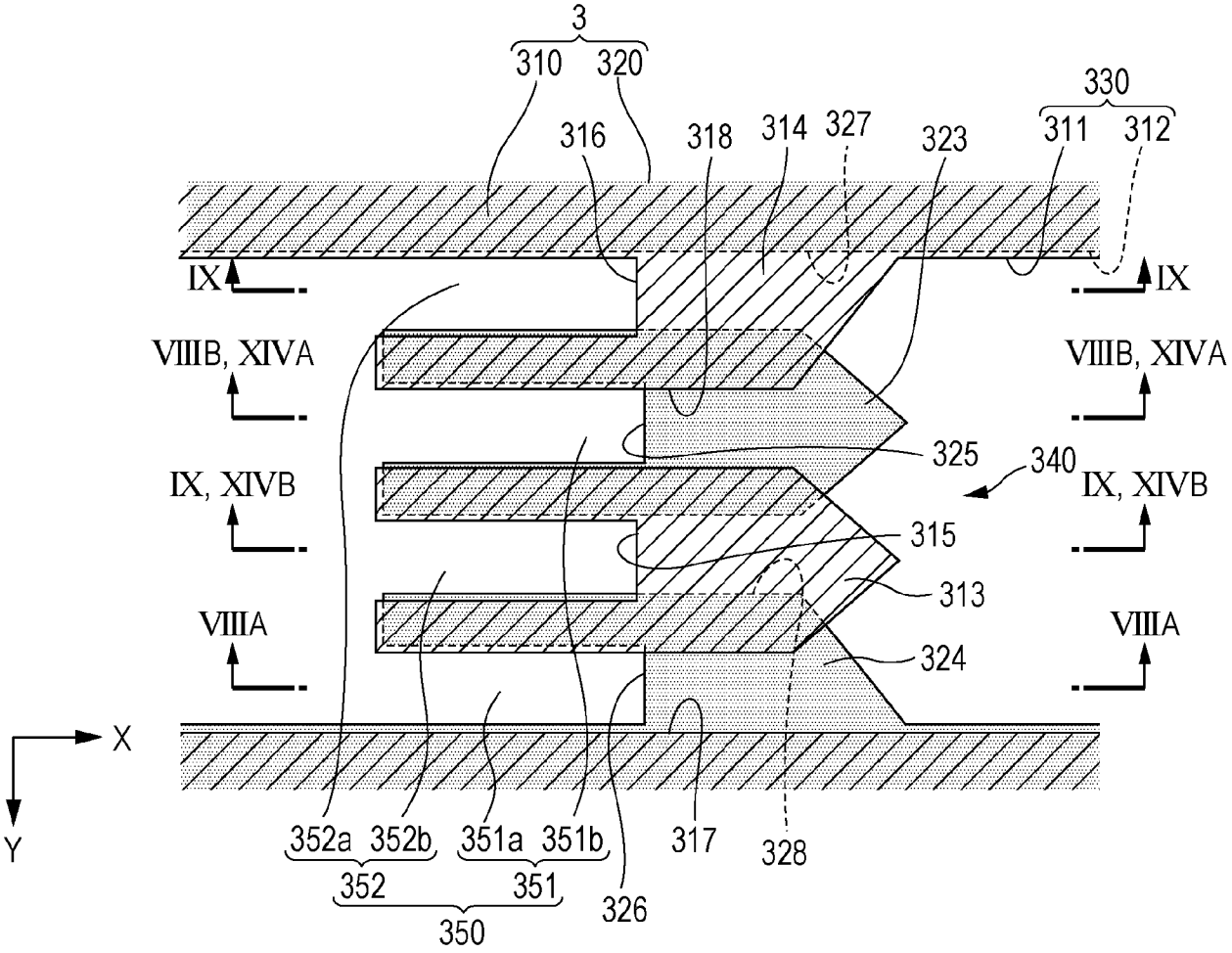
FIG. 7 is a plan view of a principal portion of the flow path member according to Embodiment 1, in which a part of the flow path member is cut off.
Figure 8A:
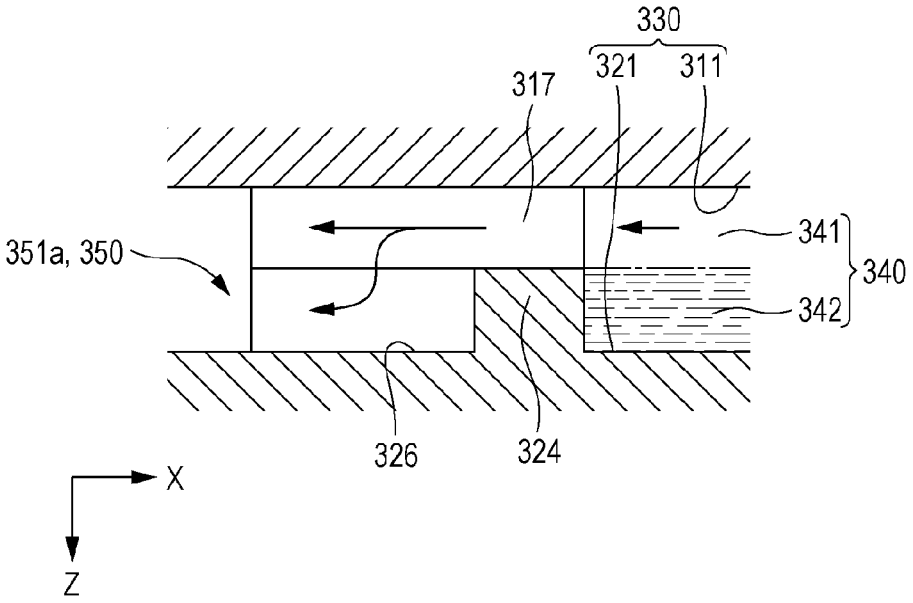
FIGS. 8A and 8B are sectional views of the principal portions of the flow path member according to Embodiment 1.
Figure 8B:
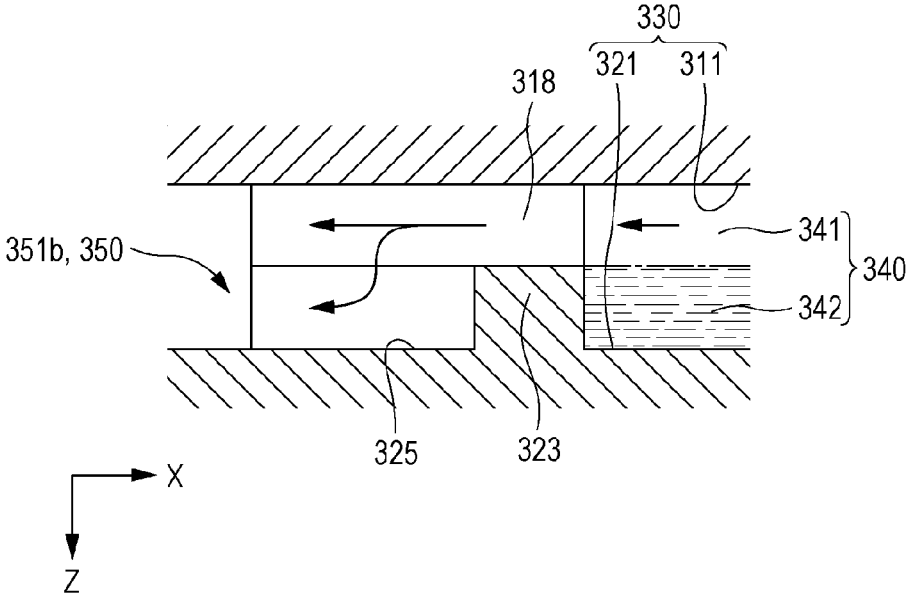
Figure 9A:
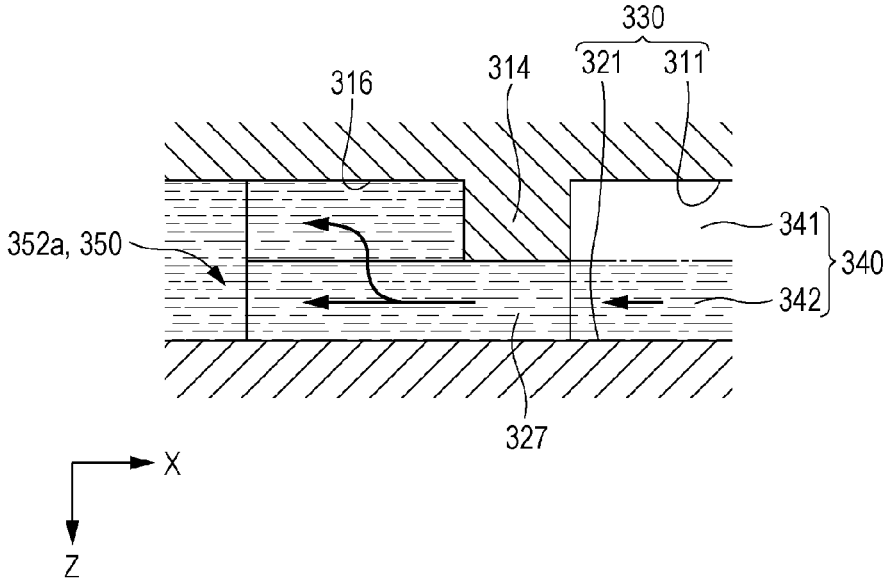
FIGS. 9A and 9B are sectional views of the principal portions of the flow path member according to Embodiment 1.
Figure 9B:
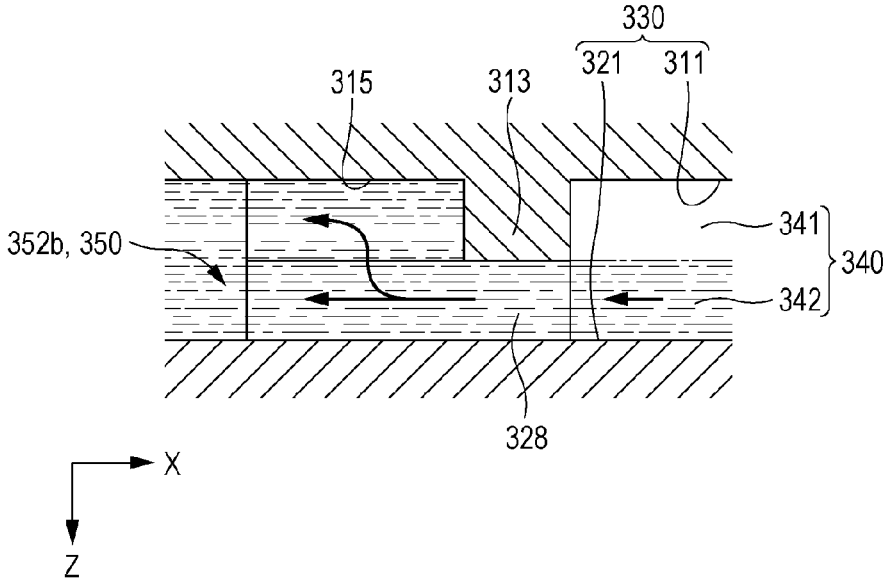
Figure 10:
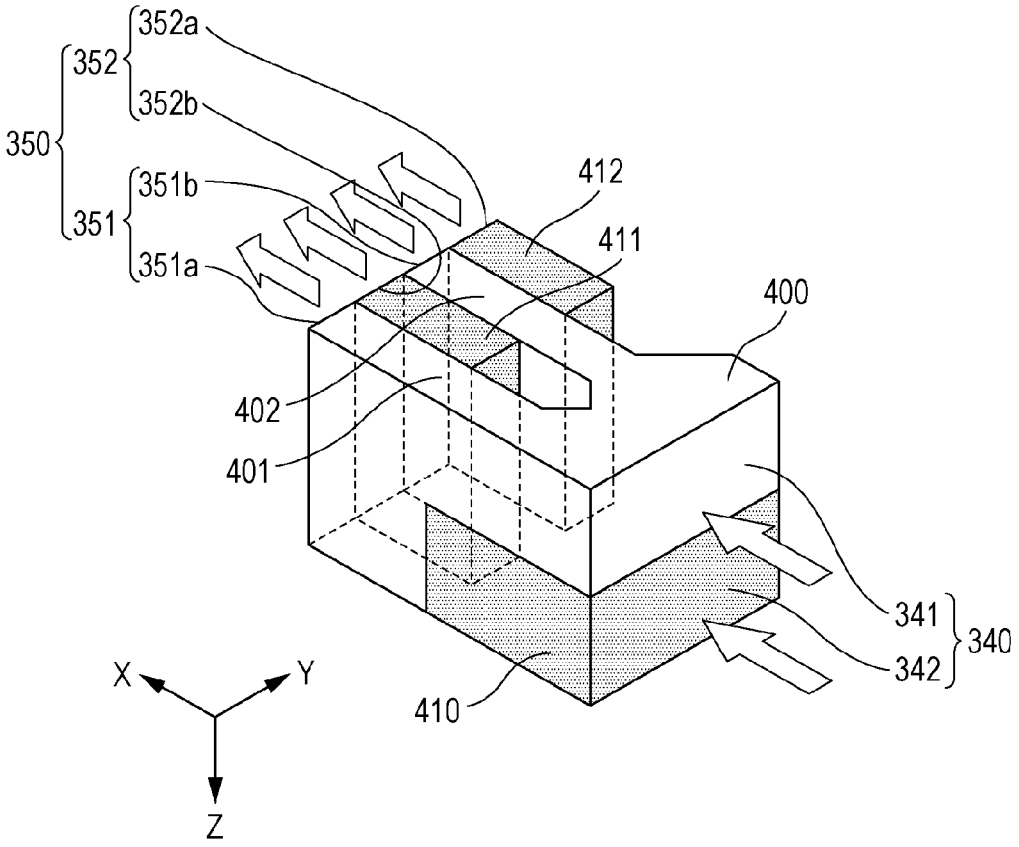
FIG. 10 is a perspective view of flow paths according to Embodiment 1.
Figure 11:
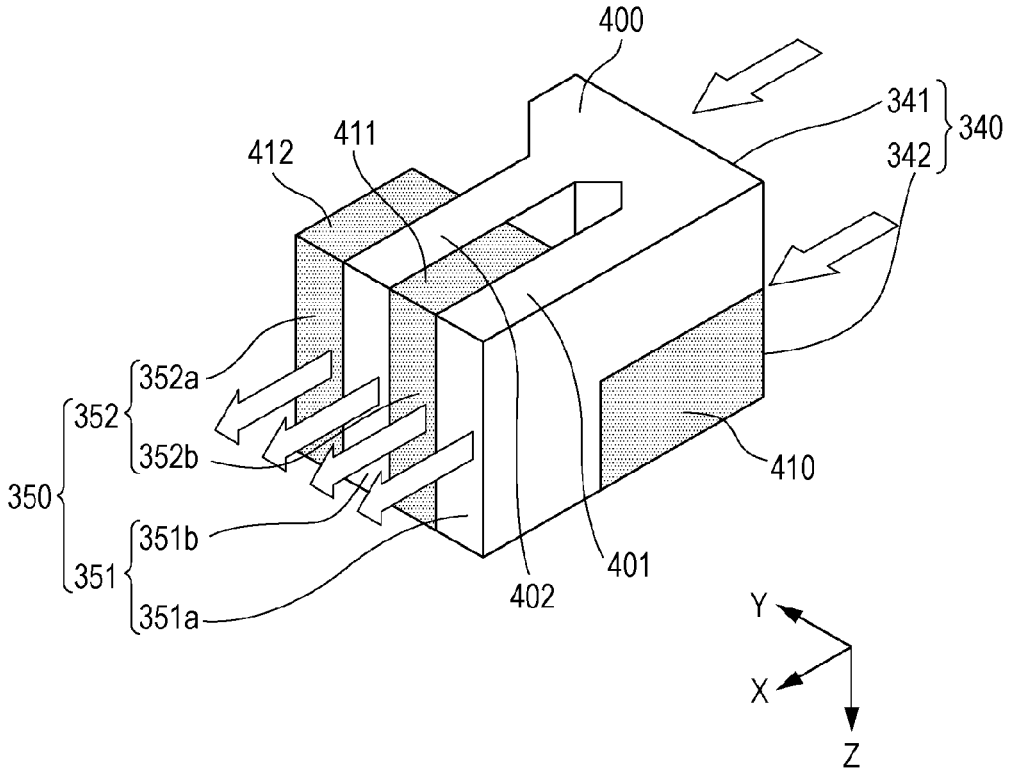
FIG. 11 is a perspective view of the flow paths according to Embodiment 1.

Here, the flow path member 3 of the embodiment will be described with reference to FIGS. 5 to 10. FIG. 5 is an exploded perspective view of the flow path member. FIG. 6A is an exploded perspective view of a principal portion of the flow path member, in which a part of the flow path member is cut off. FIG. 6B is a perspective view of the flow path member in an assembled state. FIG. 7 is a plan view of the flow path member, in which a part of the flow path member is cut off. FIG. 8A is a sectional view taken along line VIIIA-VIIIA of FIG. 7 and FIG. 8B is a sectional view taken along line VIIIB-VIIIB of FIG. 7. FIG. 9A is a sectional view taken along line IXA-IXA of FIG. 7 and FIG. 9B is a sectional view taken along the line IXB-IXB of FIG. 7. Furthermore, FIGS. 10 and 11 are perspective views illustrating the flow paths.

The head main body 2 is fixed to one surface of the flow path member 3, as illustrated in FIG. 1. Hereinafter, directions in relation to the flow path member 3 will be described in accordance with the first direction X, the second direction Y, and the third direction Z of the head main body 2. In other words, the head main body 2 is fixed to one surface side of the flow path member 3 in the third direction Z.

The flow path member 3 of the embodiment includes a first flow path member 310 and a second flow path member 320, as illustrated in FIGS. 1 to 5. The first flow path member 310 and the second flow path member 320 which constitute the flow path member 3 are laminated in the third direction Z.

In the first flow path member 310, a first concave portion 311 which is open to a surface adhering to the second flow path member 320 is provided, as illustrated in FIG. 5. The first concave portion 311 is provided in the first flow path member 310, in a state where the first concave portion 311 does not pass through the first flow path member 310 in the third direction Z, that is, the thickness direction. The first concave portion 311 having the configuration described above linearly extends in the first direction X. Furthermore, in the first flow path member 310 of the embodiment, two first concave portions 311, each of which extends in the first direction X, are aligned in the second direction Y.

A first connection port 312 is provided in one end portion of each first concave portion 311 in the first direction X. The first connection port 312 passes through the first flow path member 310 in the third direction Z and is open to the surface opposite to the second flow path member 320. Although not particularly illustrated, a liquid storage unit, such as an ink tank having ink stored therein and an ink cartridge, is directly connected to the first connection port 312 or is connected to the first connection port 312 through a supply pipe, such as a tube.

In the second flow path member 320, a second concave portion 321 is provided in a state where the second concave portion 321 is open to the surface adhering to the first flow path member 310. The second concave portion 321 is provided facing the first concave portion 311. In other words, the second concave portion 321 is provided in a state where the second concave portion 321 does not pass through the second flow path member 320 in the third direction Z, that is, the thickness direction. The second concave portion 321 having the configuration described above linearly extends in the first direction X. Two second concave portions 321, each of which extends in the first direction X, are aligned in the second direction Y.

The first flow path member 310 having the first concave portion 311 provided therein and the second flow path member 320 having the second concave portion 321 provided therein are laminated in the third direction Z. Accordingly, a liquid flow path 330 of the embodiment is formed by the first concave portion 311 and the second concave portion 321.

Furthermore, in an end portion of the second concave portion 321, which is the end portion on the side opposite to the first connection port 312 in the first direction, a second connection port 322 which passes through the second flow path member 320 in the third direction Z and is open to the surface opposite to the first flow path member 310 is provided. The introduction path 44 of the head main body 2 described above is connected to the second connection port 322, and thus the ink supplied from the liquid storage unit to the liquid flow path 330 is supplied to the introduction path 44 of the head main body 2.

In this case, the liquid flow path 330 formed by the first concave portion 311 and the second concave portion 321 includes a flow path inlet portion 340 and a flow path outlet portion 350, as illustrated in FIGS. 6A to 9B. The flow path inlet portion 340 has a first inlet port 341 and a second inlet port 342. The flow path outlet portion 350 has the first outlet port 351 communicating with the first inlet port 341 and a second outlet port 352 communicating with the second inlet port 342.

In a portion between the flow path inlet portion 340 and the flow path outlet portion 350, a first island portion 313 and a second island portion 314 which are provided in the first concave portion 311 and a third island portion 323 and a fourth island portion 324 which are provided in the second concave portion 321 are provided.

The first island portion 313 is disposed at a position separate from wall surfaces of the first concave portion 311, which are the wall surfaces on both sides in the second direction Y, in a state where the first island portion 313 is not in contact with wall surfaces of the first concave portion 311, which are the wall surfaces on both sides in a width direction, in other words, the second direction Y perpendicular to the first direction X, that is, an extending direction.

Furthermore, the thickness of a tip portion side of the first island portion 313 in the first direction X is gradually reduced in the second direction Y. In other words, in the first direction X in which the ink flows, the thickness of the tip portion side of the first island portion 313 in the first direction X is gradually reduced toward an upstream side, that is, the first connection port 312 side. The tip end of the first island portion 313 has a sharp shape, as described above. Thus, when a first laminar flow 400 of the ink branches in the second direction Y by the first island portion 313, flow path resistance in a branch point can be reduced. The details of this will be described below. In addition, the tip end of the first island portion 313 has a sharp shape. Accordingly, stagnation of ink is prevented from occurring in, for example, a corner portion which is formed by the tip end of the first island portion 313 and the bottom surface of the first concave portion 311, and thus air bubbles are prevented from staying. As a result, initial filling properties of ink and air-bubble discharge properties can be improved. Furthermore, the side surface which causes the thickness of the first island portion 313 to be gradually reduced may be a flat surface or a curved surface. In other words, when seeing the branch point in which the liquid flow path 330 branches from the upstream to the downstream, the branch point may have, at least, a shape selected from a group of square shapes and curved shapes (in other words, an R shape).

Furthermore, in the first island portion 313, a first groove portion 315 having a groove shape obtained by cutting off a part of the first island portion 313 is provided on the rear end portion side, in other words, on the downstream side, that is, the second connection port 322 side, in the first direction X. The depth of the first groove portion 315 in the third direction Z is the same as that of the first concave portion 311. The width of the first groove portion 315 in the second direction Y is smaller than that of the first island portion 313.

The second island portion 314 is disposed in a state where the second island portion 314 is positioned to be spaced apart from the first island portion 313 in the second direction Y. The second island portion 314 continuously extends in a wall surface on the side opposite to the first island portion 313.

Furthermore, the second island portion 314 is provided in a state where the thickness of the tip portion in the second direction Y is gradually reduced, as the second island portion 314 extends to the upstream side, similar to the first island portion 313. Accordingly, the flow path resistance is reduced and the ink and air bubbles are prevented from staying. As a result, ink filling properties and air-bubble discharge properties can be improved.

A second groove portion 316 is provided in a rear end portion of the second island portion 314. The depth of the second groove portion 316 in the third direction Z is the same as that of the first concave portion 311 and the width of the second groove portion 316 in the second direction Y is smaller than that of the second island portion 314, similar to the first groove portion 315 of the first island portion 313.

In the first concave portion 311, a first slit portion 317 is formed in a portion between the first island portion 313 and one wall surface of the first concave portion 311 in the second direction Y and a second slit portion 318 is provided in a portion between the first island portion 313 and the second island portion 314.

Meanwhile, the third island portion 323 formed in the second flow path member 320 is disposed at a position separate from wall surfaces of the second concave portion 321, which are the wall surfaces on both sides in the second direction Y, in a state where the third island portion 323 is not in contact with wall surfaces of the second concave portion 321, which are the wall surfaces on both sides in the width direction, in other words, the second direction Y perpendicular to the first direction X, that is, the extending direction.

Furthermore, the thickness of a tip portion side of the third island portion 323 is gradually reduced in the second direction Y, similar to the first island portion 313. In other words, in the first direction X in which the ink flows, the thickness of the tip portion side of the third island portion 323 is gradually reduced toward the upstream side, that is, the first connection port 312 side. Accordingly, the flow path resistance is reduced and the ink and air bubbles are prevented from staying. As a result, ink filling properties and air-bubble discharge properties can be improved.

Furthermore, in the third island portion 323, a third groove portion 325 having a groove shape obtained by cutting off a part of the third island portion 323 is provided on the rear end portion side, in other words, on the downstream side, that is, the second connection port 322 side, in the first direction X in which the ink flows. The depth of the third groove portion 325 in the third direction Z is the same as that of the second concave portion 321. The width of the third groove portion 325 in the second direction Y is smaller than that of the third island portion 323.

The fourth island portion 324 of the second flow path member 320 is disposed in a state where the fourth island portion 324 is positioned to be spaced apart from the third island portion 323 in the second direction Y. The fourth island portion 324 continuously extends in a wall surface on the side opposite to the third island portion 323. Furthermore, the wall surface in which the fourth island portion 324 continuously extends is located, in the second direction Y, on the side opposite to the wall surface in which the second island portion 314 continuously extends.

Furthermore, the fourth island portion 324 is provided in a state where the thickness of the tip portion in the second direction Y gradually reduces, as the fourth island portion 324 extends to the upstream side, similar to the third island portion 323. Accordingly, the flow path resistance is reduced and the ink and air bubbles are prevented from staying. As a result, ink filling properties and air-bubble discharge properties can be improved.

A fourth groove portion 326 is provided in a rear end portion of the fourth island portion 324. The depth of the fourth groove portion 326 in the third direction Z is the same as that of the second concave portion 321 and the width of the fourth groove portion 326 in the second direction Y is smaller than that of the fourth island portion 324, similar to the third groove portion 325 of the third island portion 323.

In the second concave portion 321, a third slit portion 327 is formed in a portion between the third island portion 323 and one wall surface of the second concave portion 321 in the second direction Y and a fourth slit portion 328 is provided in a portion between the third island portion 323 and the fourth island portion 324.

In the first island portion 313 and the second island portion 314 of the first flow path member 310 described above and the third island portion 323 and the fourth island portion 324 of the second flow path member 320, end surfaces facing the third direction Z adhere to one another, as illustrated in FIG. 6B. In this case, the third island portion 323 extends across a portion between the end surface of the first island portion 313 and the end surface of the second island portion 314. In other words, the third island portion 323 adheres in a state where the third island portion 323 seals an opening of the second slit portion 318. Furthermore, the fourth island portion 324 extends across a portion between the end surface of the first island portion 313 and the wall surface, and thus the fourth island portion 324 adheres so that the fourth island portion 324 seals an opening of the first slit portion 317. In other words, the first island portion 313 extends across a portion between the end surface of the third island portion 323 and the end surface of the fourth island portion 324, and thus the first island portion 313 adheres in a state where the first island portion 313 seals an opening of the fourth slit portion 328. In addition, the second island portion 314 extends across a portion between the third island portion 323 and the wall surface, and thus the second island portion 314 adheres in a state where the second island portion 314 seals an opening of the third slit portion 327. In the rear end portion of the fourth island portion 324, the first slit portion 317 communicates with the fourth groove portion 326, as illustrated in FIGS. 7 and 8A. Furthermore, in the rear end portion of the third island portion 323, the second slit portion 318 communicates with the third groove portion 325, as illustrated in FIGS. 7 and 8B. In the rear end portion of the second island portion 314, the third slit portion 327 communicates with the second groove portion 316, as illustrated in FIGS. 7 and 9A. In the rear end portion of the first island portion 313, the fourth slit portion 328 communicates with the first groove portion 315, as illustrated in FIGS. 7 and 9B. The width of the first slit portion 317 and the width of the fourth groove portion 326 are substantially the same when in the second direction Y. Accordingly, a stepped portion is prevented from being formed in a portion between the first slit portion 317 and the fourth groove portion 326, and thus an increase in the flow path resistance due to the stepped portion can be prevented from being formed. Needless to say, in a case of the other slit portions and groove portions, the widths thereof are set to be substantially the same, similar to in the case of the first slit portion 317 and the fourth groove portion 326. In other words, the width of the second slit portion 318 and the width of the third groove portion 325 are substantially the same, the width of the third slit portion 327 and the width of the second groove portion 316 are substantially the same, and the width of the fourth slit portion 328 and the width of the first groove portion 315 are substantially the same. Accordingly, the stepped portions are prevented from being formed, and thus an increase in the flow path resistance can be prevented.

In the liquid flow path 330 having the configuration described above, the flow path inlet portion 340 having the first inlet port 341 and the second inlet port 342 is provided in an area, in other words, on the first connection port 312 side, upstream from the first island portion 313, the second island portion 314, the third island portion 323, and the fourth island portion 324, as illustrated in FIGS. 7 to 9B. In the embodiment, the first inlet port 341 and the second inlet port 342 are aligned in the third direction Z. In other words, in the embodiment, a reference direction which is an alignment direction of the first inlet port 341 and the second inlet port 342 is the third direction Z. Furthermore, in the embodiment, the third direction Z is disposed to be parallel to a vertical direction. In the embodiment, a port on the upper side in the vertical direction will be referred to as the first inlet port 341 and a port on the lower side in the vertical direction will be referred to as the second inlet port 342.

The first inlet port 341 communicates with both the first slit portion 317 and the second slit portion 318 which are located in a portion between the first island portion 313 and the second island portion 314. In the rear end portion of the fourth island portion 324, the first slit portion 317 located in the portion between the first island portion 313 and the second island portion 314 communicates with the fourth groove portion 326. In the rear end portion of the third island portion 323, the second slit portion 318 located in the portion between the first island portion 313 and the second island portion 314 communicates with the third groove portion 325. In the embodiment, in the rear end portions of the first island portion 313, the second island portion 314, the third island portion 323, and the fourth island portion 324, the downstream side of the group of the first slit portion 317 and the fourth groove portion 326 forms a flow path outlet port 351*a* of the embodiment and the downstream side of the group of the second slit portion 318 and the third groove portion 325 forms a flow path outlet port 351*b* of the embodiment. In other words, the first outlet port 351 communicating with the first inlet port 341 includes the two flow path outlet ports 351*a* and 351*b*. Flow paths which allow the first inlet port 341 to communicate with the first outlet port 351 are constituted of a group of the first slit portion 317 and the fourth groove portion 326 and a group of the second slit portion 318 and the third groove portion 325, as described above.

Furthermore, the second inlet port 342 communicates with both the third slit portion 327 and the fourth slit portion 328 which are located in a portion between the third island portion 323 and the fourth island portion 324. In the rear end portion of the second island portion 314, the third slit portion 327 located in the portion between the third island portion 323 and the fourth island portion 324 communicates with the second groove portion 316. In the rear end portion of the first island portion 313, the fourth slit portion 328 located in the portion between the third island portion 323 and the fourth island portion 324 communicates with the first groove portion 315. In the embodiment, in the rear end portions of the first island portion 313, the second island portion 314, the third island portion 323, and the fourth island portion 324, the downstream side of the group of the third slit portion 327 and the second groove portion 316 forms a flow path outlet port 352*a* of the embodiment and the downstream side of the group of the fourth slit portion 328 and the first groove portion 315 forms a flow path outlet port 352*b* of the embodiment. In other words, the second outlet port 352 communicating with the second inlet port 342 includes the two flow path outlet ports 352*a* and 352*b*. Furthermore, in the embodiment, a portion constituted of both the first outlet port 351 and the second outlet port 352 will be referred to as the flow path outlet portion 350. Flow paths which allow the second inlet port 342 to communicate with the second outlet port 352 are constituted of a group of the third slit portion 327 and the second groove portion 316 and a group of the second slit portion 318 and the first groove portion 315, as described above.

The group of the first slit portion 317 and the fourth groove portion 326, the group of the second slit portion 318 and the third groove portion 325, the group of the third slit portion 327 and the second groove portion 316, and the group of the fourth slit portion 328 and the first groove portion 315 are aligned in the second direction Y. In other words, The two flow path outlet ports 351*a* and 351*b* of the first outlet port 351 and the two flow path outlet ports 352*a* and 352*b* of the second outlet port 352 are aligned in the second direction Y crossing in the reference direction (in other words, the third direction Z), that is, the alignment direction of the first inlet port 341 and the second inlet port 342, in a state where the flow path outlet ports are alternately aligned. Accordingly, in the flow path extending from the first inlet port 341 to the first outlet port 351 and the flow path extending from the second inlet port 342 to the second outlet port 352, at least parts of the flow paths, in terms of the lengths of the respective flow paths, are disposed in the second direction which is a direction different from the third direction Z as the reference direction, as illustrated in FIGS. 10 and 11. Furthermore, in the embodiment, in the flow path extending from the first inlet port 341 to the first outlet port 351 and the flow path extending from the second inlet port 342 to the second outlet port 352, at least parts of the flow paths, in terms of the lengths of the respective flow paths, include the group of the first inlet port 341 and the first outlet port 351 and the group of the second inlet port 342 and the second outlet port 352. Practically, the first inlet port 341 and the second inlet port 342 are the tip portion of the first island portion 313, which is the end portion on the upstream side in the first direction X. The first outlet port 351 and the second outlet port 352 are the rear end portion of the first island portion 313, which is the end portion on the downstream side in the first direction X.

In this case, when a certain time elapsed in a state where the inner portion of the liquid flow path 330 is filled with the ink, components contained in the ink are sedimented by the gravity, and thus a first laminar flow 400 having a low concentration is formed on the upper side in the vertical direction and a second laminar flow 410 having a high concentration is formed on the lower side in the vertical direction, as illustrated in FIGS. 10 and 11. In the liquid flow path 330 of the embodiment, even when sedimentation of the components in the ink occurs due to gravity, as described above, the first laminar flow 400 flows in from the first inlet port 341 and branches into two separate flows in the middle of the flow path and the second laminar flow 410 flows in from the second inlet port 342 and branches into two flows in the middle of the flow path. The two branched flows of the first laminar flow 400 form a first branch laminar flow 401 and a second branch laminar flow 402. The branched two flows of the second laminar flow 410 form a third branch laminar flow 411 and a fourth branch laminar flow 412. The first branch laminar flow 401 and the second branch laminar flow 402 which are branched flows of the first laminar flow 400 flow out through the flow path outlet ports 351*a* and 351*b* of the first outlet port 351. The third branch laminar flow 411 and the fourth branch laminar flow 412 which are branched flows of the second laminar flow 410 flow out through the flow path outlet ports 352*a* and 352*b* of the second outlet port 352. In other words, the first branch laminar flow 401 and the second branch laminar flow 402 which are the branched flows of the first laminar flow 400 and the third branch laminar flow 411 and the fourth branch laminar flow 412 which are the branched flows of the second laminar flow 410 are alternately disposed in the second direction Y. Accordingly, in a portion extending from the flow path inlet portion 340 to the flow path outlet portion 350, the arrangement of the first laminar flow 400 having a low ink concentration and the second laminar flow 410 having a high ink concentration can be changed to an arrangement in which the alignment direction of the laminar flow is changed to a different direction. Accordingly, in an area downstream from the flow path outlet portion 350, the components of the ink are dispersed in the third direction Z, and thus a deviation in the concentration distribution of the ink can ease off. Furthermore, in the middle of the flow path, the arrangement of the first laminar flow 400 and the second laminar flow 410 is changed to an arrangement in which the alignment direction of the laminar flows is changed to a different direction. As a result, the first laminar flow 400 and the second laminar flow can be diffused, and thus the deviation in the concentration of the entirety of the ink can ease off. Each of the first laminar flow 400 and the second laminar flow 410 branches into two flows and the branched flows form four laminar flows of the first branch laminar flow 401, the second branch laminar flow 402, the third branch laminar flow 411, and the fourth branch laminar flow 412, and thus the number of boundaries between the laminar flows having different concentrations is increased and diffusion of the ink in the boundaries can occur by Brownian motion. In other words, compared to the fact that, in the flow path inlet portion 340, the number of boundaries between the laminar flows (in other words, the first laminar flow 400 and the second laminar flow 410) having different concentrations is only one, and in the flow path outlet portion 350, the number of boundaries between the laminar flows (in other words, the first branch laminar flow 401, the second branch laminar flow 402, the third branch laminar flow 411, and the fourth branch laminar flow 412) having different concentrations can be increased to three. Accordingly, the number of boundaries between the laminar flows having different concentrations is increased, and thus the ink is diffused. As a result, the sedimentation of the components of the ink can ease off.

It is preferable that the height of the second inlet port 342 in the vertical direction, which is disposed on the lower side in the vertical direction, is set to a value equal to or greater than the maximum sedimentation height of the sedimentation components contained in the ink. In other words, the height of the third island portion 323 in the third direction Z or the height of the fourth island portion 324 in the third direction Z is set to a value equal to or greater than the maximum sedimentation height, and thus the concentration of the ink in a state where, in the flow path outlet portion 350, the sedimentation of the components of the ink is prevented to the maximum can be leveled in the third direction Z. Incidentally, the maximum sedimentation height of the sedimentation components contained in the ink is the height of the components in a state where, when the liquid flow path 330 is filled with the ink and a certain period of time elapsed, the components contained in the ink cannot be sedimented over the maximum height. The maximum sedimentation height is determined in accordance with the type of ink or a material of a sedimentation component.

In the embodiment, the first inlet port 341 and the first outlet port 351 (in other words, the flow path outlet ports 351*a* and 351*b*) have substantially the same flow-path sectional area, in other words, an opening area. Accordingly, a difference between the flow path resistance in the first inlet port 341 and the flow path resistance in the first outlet port 351 can be prevented. Similarly, the second inlet port 342 and the second outlet port 352 (in other words, the flow path outlet ports 352*a* and 352*b*) have substantially the same flow-path sectional area, in other words, an opening area. Accordingly, a difference between the flow path resistance in the second inlet port 342 and the flow path resistance in the second outlet port 352 can be prevented.

Figure 12A:
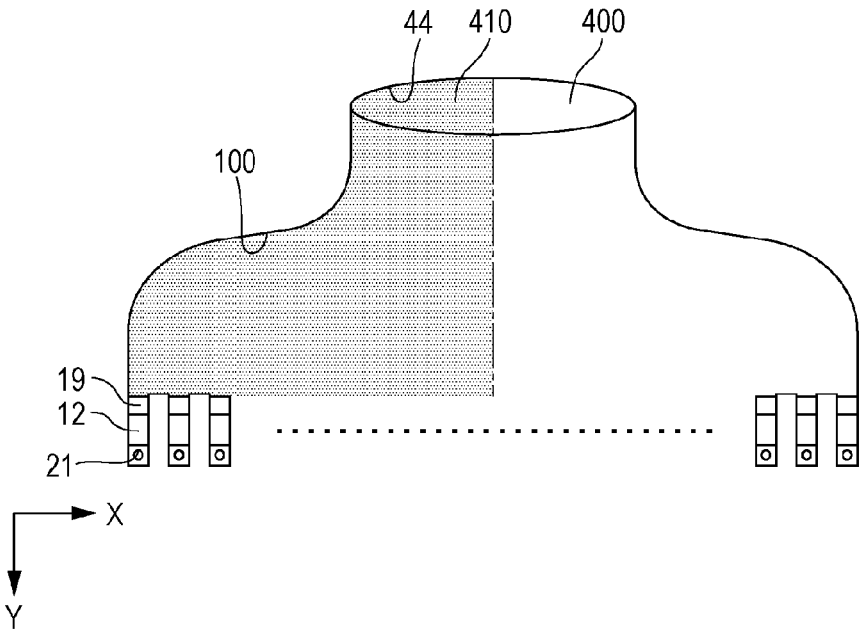
FIGS. 12A and 12B are schematic views illustrating positional relationships between a manifold and the flow path according to Embodiment 1.
Figure 12B:
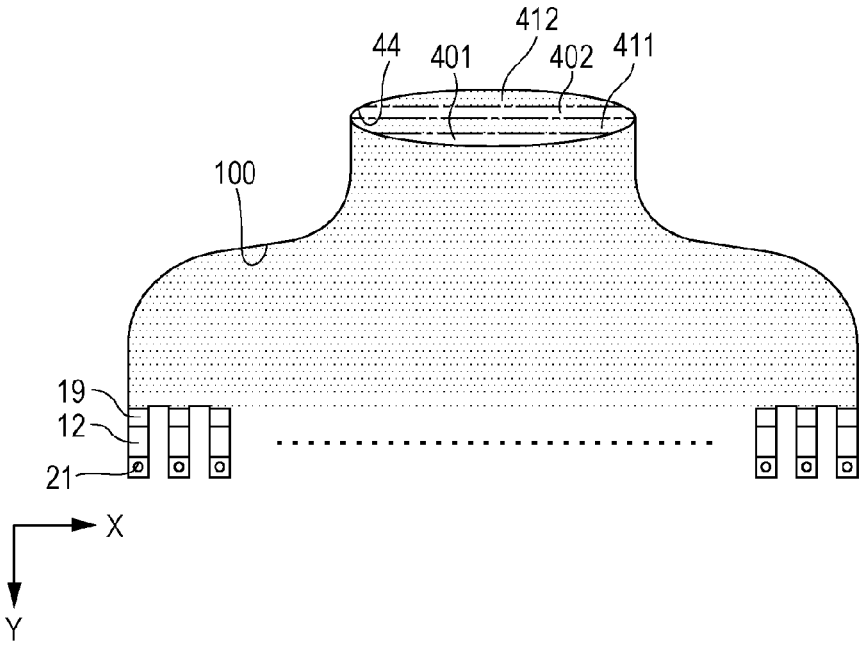

In the embodiment, in the second connection port 322, the liquid flow path 330 is connected to the introduction path 44 of the head main body 2. In this case, when the first laminar flow 400 and the second laminar flow 410 are supplied to the manifold 100 without, for example, the first island portion 313, the second island portion 314, the third island portion 323, and the fourth island portion 324, in a state where the first laminar flow 400 and the second laminar flow 410 are aligned in the third direction Z, an area in the manifold 100 is divided, in the first direction, into an area receiving the first laminar flow 400 having a low concentration and an area receiving the second laminar flow 410 having high concentration, as illustrated in FIG. 12A. Accordingly, a plurality of pressure generation chambers 12 are divided into a group of the pressure generation chambers 12 receiving only the first laminar flow 400 having a low concentration and a group of the pressure generation chambers 12 receiving only the second laminar flow 410 having high concentration. As a result, unevenness of concentration occurs in a matter printed using the ink ejected from the pressure generation chambers 12. In contrast, in the embodiment, the first island portion 313, the second island portion 314, the third island portion 323, and the fourth island portion 324 are provided. Accordingly, the arrangement of the first laminar flow 400 and the second laminar flow 410 which are aligned in the third direction Z by the ink components sedimented by the gravity can be changed to the arrangement in which, in the flow path outlet ports 351*a*, 351*b*, 352*a*, and 352*b*, the first branch laminar flow 401, the second branch laminar flow 402, the third branch laminar flow 411, and the fourth branch laminar flow 412 are aligned in the second direction Y. Accordingly, the alignment direction (in other words, the second direction Y) of the first branch laminar flow 401, the second branch laminar flow 402, the third branch laminar flow 411, and the fourth branch laminar flow 412 and the alignment direction (in other words, the first direction X) of the supply communication paths 19 which allow the manifold 100 to communicate with the pressure generation chamber 12 which is an individual flow path can be set to be different from each other, as illustrated in FIG. 12B. Thus, the manifold 100 is filled with the ink of which the sedimentation of the components ease off in the first direction X. In other words, the manifold 100 is filled with the ink of which the deviation in the concentration is prevented. As a result, unevenness of concentration in a printed matter is prevented, and thus the printing quality can be improved. FIGS. 12A and 12B are schematic views illustrating flow paths extending from the introduction path 44 to the nozzle opening 21.

Embodiment 2

Figure 13:
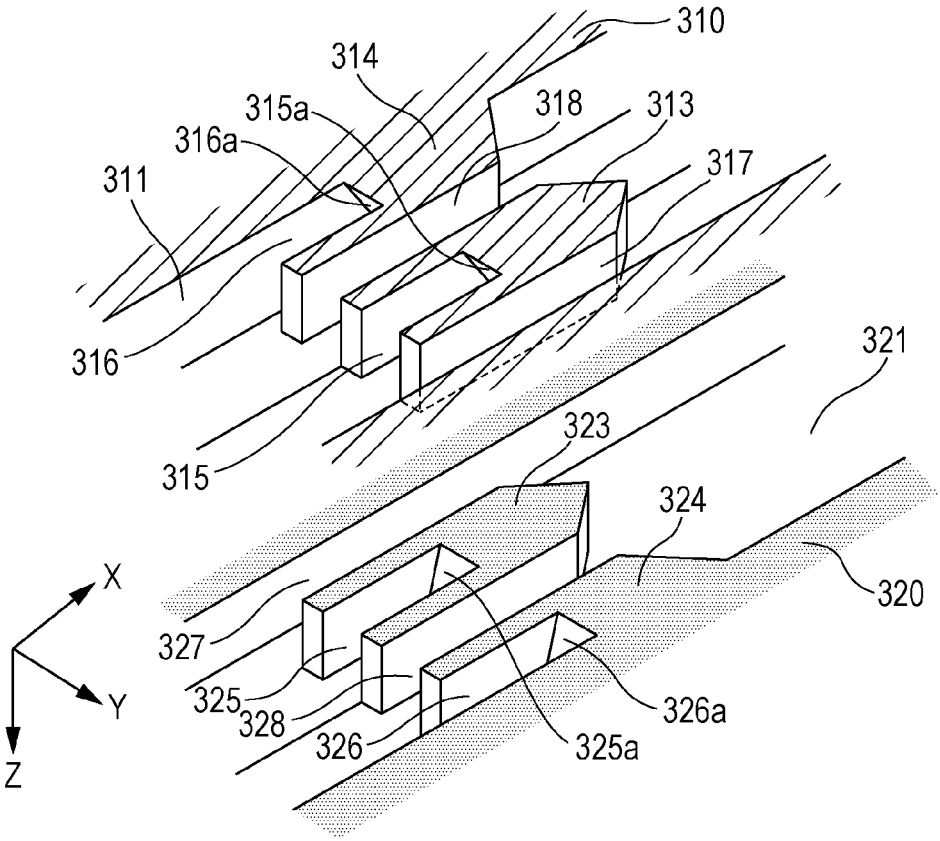
FIG. 13 is a perspective view of a principal portion of a flow path member according to Embodiment 2, in which a part of the flow path member is cut off.
Figure 14A:
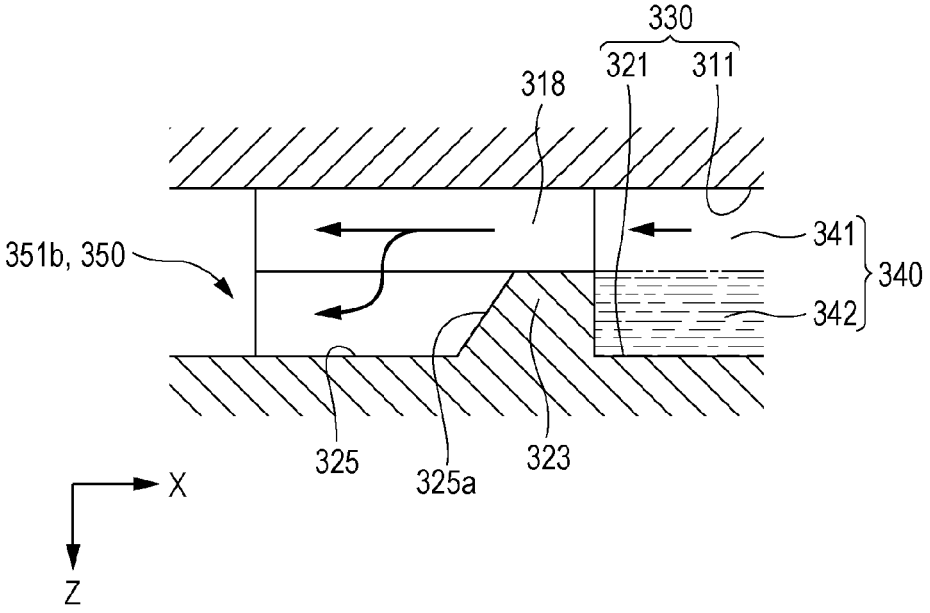
FIGS. 14A and 14B are sectional views of principal portions of the flow path member according to Embodiment 2.
Figure 14B:
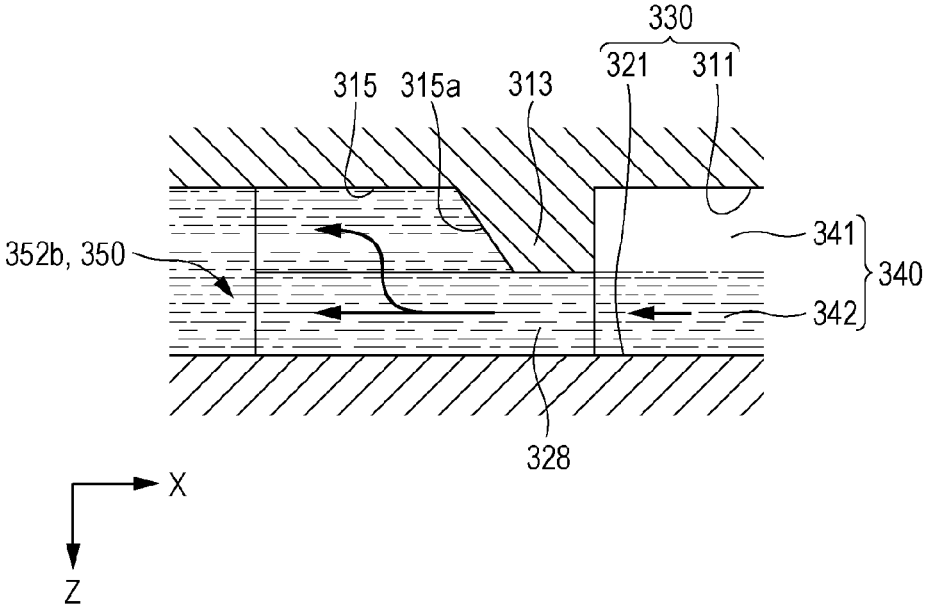

FIG. 13 is an exploded perspective view of a principal portion of a flow path member according to Embodiment 2 of the invention. FIG. 14A is a sectional view taken along line XIVA-XIVA of FIG. 7 and FIG. 14B is a sectional view taken along line XIVB-XIVB of FIG. 7. The same reference numerals and letters are given to components of which the configurations are the same as those of Embodiment 1 described above. The descriptions thereof will not be repeated.

The first groove portion 315 provided in the rear end of the first island portion 313 is formed in a shape in which the depth of the first groove portion 315 is gradually increased as the first groove portion 315 extends to the rear end portion side, as illustrated in FIGS. 13 and 14B. In other words, a flow-path inner wall surface 315*a* of the first groove portion 315 in the second direction Y is inclined in relation to the third direction Z, that is, the reference direction. In other words, the flow path extending from the first inlet port 341 to the first outlet port 351 has the flow-path inner wall surface 315*a* of which the width in the third direction Z is gradually increased as the flow-path inner wall surface 315*a* extends to the first outlet port 351. Also, a flow-path inner wall surface 316*a* is provided in the second groove portion 316 of the second island portion 314, as illustrated in FIG. 13.

Similarly, the third groove portion 325 provided in the rear end of the third island portion 323 is formed in a shape in which the depth of the third groove portion 325 is gradually increased as the third groove portion 325 extends to the rear end portion side, as illustrated in FIGS. 13 and 14A. In other words, the flow path extending from the second inlet port 342 to the second outlet port 352 has the flow-path inner wall surface 325*a* of which the width in the third direction Z is gradually increased as the flow-path inner wall surface 325*a* extends to the second outlet port 352. Also, a flow-path inner wall surface 326*a* is provided in the fourth groove portion 326 of the fourth island portion 324, as illustrated in FIG. 13.

In a case of the configuration described above, when ink flows from the second slit portion 318 to the third groove portion 325, the ink can be prevented from staying in a corner portion between the third groove portion 325 and the bottom surface of the second concave portion 321 due to the flow-path inner wall surface 325*a* having an inclined shape, as illustrated in FIG. 14A. As a result, staying of air bubbles is prevented, and thus the initial filling properties of the ink and the air-bubble discharge properties can be improved. Similarly, in a case of the other flow paths, the flow-path inner wall surfaces 315*a*, 316*a*, and 326*a* are provided, in such a manner that staying of ink is prevented, and thus ink filling properties and the air-bubble discharge properties can be improved.

Other Embodiments

Hereinbefore, embodiments of the invention are described. However, the basic configurations of the invention are not limited to the configurations described above.

In the embodiments described above, the first island portion 313 and the second island portion 314 are provided in the first flow path member 310 and the third island portion 323 and the fourth island portion 324 are provided in the second flow path member 320, in such a manner that, in the flow path outlet portion 350, the flow path extending from the first inlet port 341 to the first outlet port 351 and the flow path extending from the second inlet port 342 to the second outlet port 352 are disposed in the second direction Y which is a direction rotated by 90 degrees in relation to the third direction Z, that is, the alignment direction of the first inlet port 341 and the second inlet port 342. However, the configuration is not limited thereto. A plurality of stages of, for example, the first island portions 313, the second island portions 314, the third island portions 323, and the fourth island portions 324 are provided in the flowing direction of the ink in the liquid flow path 330, in such a manner that, in the flow path outlet portion 350, the flow path extending from the first inlet port 341 to the first outlet port 351 and the flow path extending from the second inlet port 342 to the second outlet port 352 may be disposed in a direction, in other words, a −Z direction, rotated by 180 degrees in relation to the third direction Z, that is, the alignment direction of the first inlet port 341 and the second inlet port 342. Furthermore, the plurality of stages of, for example, the first island portions 313, the second island portions 314, the third island portions 323, and the fourth island portions 324 are provided in the flowing direction of the ink in the liquid flow path 330, in such a manner that the number of branched flows of both the first laminar flow 400 and the second laminar flow 410 can be multiplied by the number of the installation stages. As a result, the ink stirring effect can be further increased, and thus a deviation of the ink concentration in the third direction Z can ease off.

In the embodiments described above, each of the first laminar flow 400 and the second laminar flow 410 branches into two flows. However, the configuration thereof is not limited thereto. Only either the first laminar flow 400 or the second laminar flow 410 may branch into two flows or neither the first laminar flow 400 nor second laminar flow 410 may branch into two flows. Furthermore, the number of branched flows of each of the first laminar flow 400 and the second laminar flow 410 is not limited to two and may be three or more.

In the embodiments described above, the first flow path member 310 and the second flow path member 320 are laminated, in such a manner that the flow path member 3 is constituted and the liquid flow path 330 is formed in a portion between the first flow path member 310 and the second flow path member 320. However, the configuration thereof is not limited thereto. The liquid flow path 330 may be formed by laminating three or more members. Furthermore, a laminated direction of the first flow path member 310 and the second flow path member 320 is not limited to the third direction Z. The laminated direction may be an in-plane direction including the first direction X and the second direction Y. The laminated direction is not particularly limited.

Figure 15:
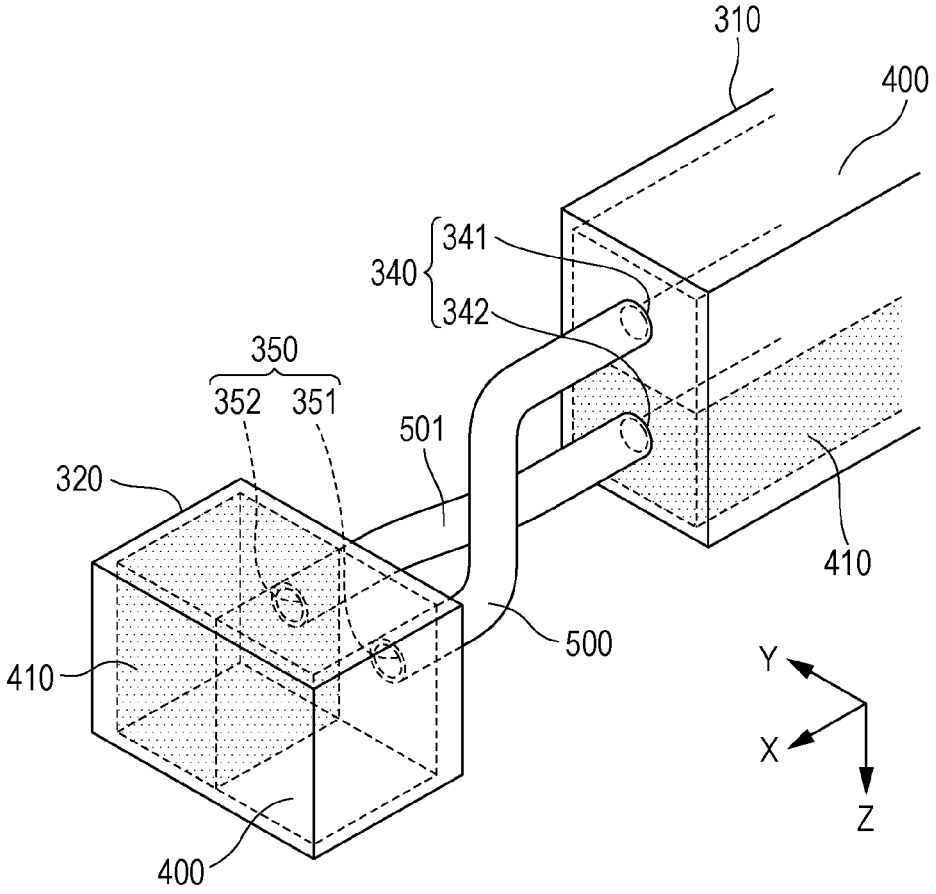
FIG. 15 is a perspective view of a flow path member according to another embodiment.

In the embodiments described above, the liquid flow path 330 is formed in a member constituted of the first flow path member 310 and the second flow path member 320 laminated onto each other and the alignment direction of the first inlet port 341 and the second inlet port 342 of the liquid flow path 330 is changed by four island portions 313, 314, 323, and 324. However, the configuration thereof is not limited thereto. The arrangement of the first inlet port 341 and the second inlet port 342 may be changed using, for example, a tubular member, such as a tube. Such an example is illustrated in FIG. 15. FIG. 15 is a schematic perspective view illustrating a flow path member according to another embodiment.

The first flow path member 310 and the second flow path member 320 are connected by two tubular members 500 and 501, as illustrated in FIG. 15. The tubular member 500 may be a member having flexibility or may be a member having no flexibility.

One end of the tubular member 500 is connected to the first inlet port 341 of the first flow path member 310 and one end of the tubular member 501 is connected to the second inlet port 342 of the first flow path member 310. The other end of the tubular member 500 is connected to the first outlet port 351 of the second flow path member 320 and the other end of the tubular member 501 is connected to the second outlet port 352 of the second flow path member 320. The two tubular members 500 and 501 are connected to the first flow path member 310, in a state where the tubular members 500 and 501 are aligned in the third direction Z, that is, the vertical direction. In the middle of the flow path, the alignment direction of the two tubular members 500 and 501 are bent in a direction, which is the second direction Y in the embodiment, crossing the third direction Z. The tubular member 500 is connected to the first outlet port 351 of the second flow path member 320 and the tubular member 501 is connected to the second outlet port 352 of the second flow path member 320, in a state where the tubular members 500 and 501 are aligned in the second direction Y. Even in such a configuration, the arrangement of the first laminar flow 400 and the second laminar flow 410 which are aligned in the third direction Z, in the first flow path member 310, can be changed to the arrangement in which the first laminar flow 400 and the second laminar flow 410 are aligned in the second direction Y. Accordingly, the concentration distribution of the ink can be improved, and thus the printing quality can be improved. Furthermore, in the middle of the flow path, each of the tubular members 500 and 501 branches into two tubular members, in such a manner that four flow path outlet ports can be alternately disposed in the second direction Y, similar to Embodiment 1.

In the embodiment, the third direction Z is the vertical direction. However, the configuration thereof is not particularly limited thereto. The flow path member 3 may be arranged in a state where the first direction X is the vertical direction. Even in this case, when a flow path having a vector of a horizontal component perpendicular to the vertical direction is provided on an upstream side of the liquid flow path 330 of the flow path member 3, although sedimentation of the components contained in the ink occurs, the sedimentation of the components of the ink in a state where the components are sedimented in the vertical direction can ease off by the liquid flow path 330 provided on the downstream side.

In the embodiments described above, it is configured so that the flow path forming substrate 10 and the nozzle plate 20 adhere to each other through the communication plate 15. However, the configuration thereof is not limited thereto. The flow path forming substrate 10 and the nozzle plate 20 may directly adhere to each other.

In the description of the embodiments, the piezoelectric actuator 300 of a thin-film type is used as the pressure generation unit which causes a pressure change in the pressure generation chambers 12. However, the configuration thereof is not limited thereto. For example, a thick-film type piezoelectric actuator which is formed by bonding, for example, a green sheet or a longitudinal oscillation type piezoelectric actuator which is formed by alternately laminating a piezoelectric material and an electrode forming material and is subjected to expansion/contraction in an axial direction can be used as the pressure generation unit. For example, a unit in which a heating element is disposed in the pressure generation chamber and liquid droplets are formed from the nozzle openings by bubbles generated by heating of the heating element or a so-called electrostatic actuator in which static electricity is generated between a diaphragm and an electrode and liquid droplets are discharged from the nozzle openings by the diaphragm deformed by an electrostatic force can be used as the pressure generation unit.

Figure 16:
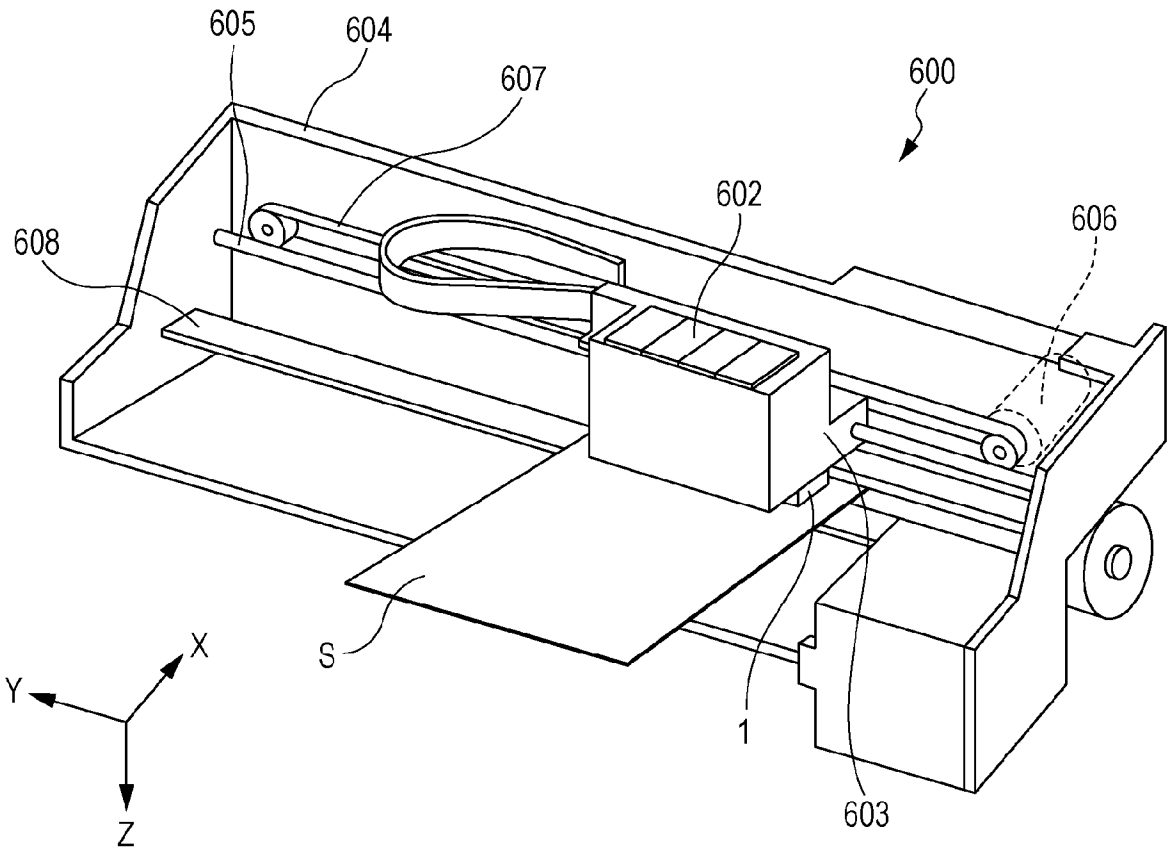
FIG. 16 is a schematic view of a recording apparatus according to an embodiment.

The ink jet type recording head 1 of the embodiments described above is mounted in an ink jet type recording apparatus. FIG. 16 is a schematic view illustrating an example of the ink jet type recording apparatus.

In an ink jet type recording apparatus 600 illustrated in FIG. 16, the ink jet type recording head 1 is mounted on a carriage 603. An ink cartridge 602 as a liquid storage unit is detachably mounted on the carriage 603. The carriage 603 is provided in a carriage shaft 605 attached to an apparatus main body 604, in a state where the carriage 603 can move in an axial direction.

A driving force from a driving motor 606 is transmitted to the carriage 603 through a plurality of gears (not illustrated) and a timing belt 607, in such a manner that the carriage 603 mounted on the ink jet type recording head 1 moves along the carriage shaft 605. Meanwhile, a transporting roller 608 is provided, as a transporting unit, in the apparatus main body 604 and a recording sheet S which is a recording medium, such as a paper sheet, is transported by the transporting roller 608. The transporting unit for transporting the recording sheet S is not limited to a transporting roller. The transporting unit may be a belt, a drum, or the like.

In the ink jet type recording apparatus 600 described above, a configuration in which the ink jet type recording head 1 is mounted on the carriage 603 and moves in a main scanning direction is exemplified. However, the configuration thereof is not limited thereto. The invention can also be applied to, for example, a so-called line type recording apparatus in which the ink jet type recording head 1 is fixed and only the recording sheet S, such as a paper sheet, is moved in a sub-scanning direction, in such a manner that printing is performed.

In the example described above, the ink jet type recording apparatus 600 has a configuration in which the ink cartridge 602 as the liquid storage unit is mounted on the carriage 603. However, the configuration thereof is not limited thereto. It may be configured so that a liquid storage unit, such as an ink tank, is fixed to, for example, the apparatus main body 604 and the liquid storage unit and the ink jet type recording head 1 are connected through a supply pipe, such as a tube. Furthermore, the liquid storage unit may not be mounted in an ink jet type recording apparatus. In the embodiments described above, the flow path member 3 is provided in the ink jet type recording head 1. However, the configuration thereof is not limited thereto. The flow path member 3 of the embodiments described above may be provided in, for example, a liquid storage unit fixed to the apparatus main body 604 of the ink jet type recording apparatus. In other words, the flow path member 3 is not limited to a flow path member provided in the ink jet type recording head 1 of the 600. The flow path member 3 may be a flow path member provided in other member.

The invention is intended to be applied to general liquid ejecting heads. The invention can also be applied to various types of a recording head, such as an ink jet type recording head, used for an image recording apparatus, such as a printer, a coloring material ejecting head used to manufacture a color filter for a liquid crystal display or the like, an electrode material ejecting head used to form an electrode for an organic EL display, a field emission display (FED) or the like, and a bio-organic material ejecting head used to manufacture a biochip.

Application of the invention is not intended to be limited to a flow path member used for a liquid ejecting head and a liquid ejecting apparatus. The invention can also be applied to a flow path member used for other devices.

What is claimed is:

1. A flow path member comprising:

a liquid flow path which includes a flow path inlet portion which has a first inlet port and a second inlet port, and a flow path outlet portion which has a first outlet port communicating with the first inlet port and a second outlet port communicating with the second inlet port, wherein, in the flow path inlet portion, the first inlet port and the second inlet port are aligned in a reference direction that is transverse to a liquid flow direction, and wherein, in a flow path extending from the first inlet port to the first outlet port and a flow path extending from the second inlet port to the second outlet port, at least parts of the flow paths, in terms of the lengths of the respective flow paths, are disposed in a direction different from the reference direction, wherein the reference direction which is an alignment direction of the first inlet port and the second inlet port is a vertical direction and the second inlet port is disposed on a lower side in the vertical direction.

2. The flow path member according to claim 1, wherein each of the first outlet port and the second outlet port has at least two or more flow path outlet ports, and wherein respective outlet ports of the first outlet port and respective outlet ports of the second outlet port are alternately disposed.

3. The flow path member according to claim 2, wherein, when seeing a branch point in which the flow path branches in a portion between the first inlet port and the first outlet port from an upstream side to a downstream side in the liquid flow path, the branch point has, at least, a shape selected from a group of square shapes and curve shapes.

4. A liquid ejecting head comprising:

path member according to claim 3.

5. A liquid ejecting apparatus comprising:

path member according to claim 3.

6. A liquid ejecting head comprising:

path member according to claim 2.

7. A liquid ejecting apparatus comprising:

path member according to claim 2.

8. The flow path member according to claim 1, wherein at least either a group of a flow path of the first inlet port and a flow path of the first outlet port or a group of a flow path of the second inlet port and a flow path of the second outlet port has the same flow-path sectional area.

9. A liquid ejecting head comprising:

path member according to claim 8.

10. A liquid ejecting apparatus comprising:

path member according to claim 8.

11. The flow path member according to claim 1, wherein, in a portion between the first inlet port and the first outlet port, a flow-path inner wall surface having an inclined shape is provided so that a width of the liquid flow path in the reference direction is gradually increased, as the liquid flow path extends to the first outlet port, and wherein in a portion between the second inlet port and the second outlet port, a flow-path inner wall surface having an inclined shape is provided so that a width of the liquid flow path in the reference direction is gradually increased, as the liquid flow path extends to the second outlet port.

12. A liquid ejecting head comprising:

path member according to claim 11.

13. A liquid ejecting apparatus comprising:

path member according to claim 11.

14. The flow path member according to claim 1, wherein a height of the second inlet port in the vertical direction is set to a value equal to or greater than a maximum sedimentation height of sedimentation components contained in the liquid.

15. A liquid ejecting head comprising:

path member according to claim 14.

16. A liquid ejecting apparatus comprising:

path member according to claim 14.

17. A liquid ejecting head comprising:

path member according to claim 1.

18. A liquid ejecting apparatus comprising:

path member according to claim 1.

19. A liquid stirring method in which a liquid flow path includes a flow path inlet portion which has a first inlet port and a second inlet port, and a flow path outlet portion which has a first outlet port communicating with the first inlet port and a second outlet port communicating with the second inlet port, the method comprising:

aligning the first inlet port and the second inlet port in the flow path inlet portion in a reference direction that is transverse to liquid flow direction; and disposing at least parts of a flow path extending from the first inlet port to the first outlet port and a flow path extending from the second inlet port to the second outlet port in terms of the lengths of the respective flow paths, in a direction intersecting the reference direction, wherein the reference direction which is an alignment direction of the first inlet port and the second inlet port is a vertical direction and the second inlet port is disposed on a lower side in the vertical direction.

* * * * *